US010670280B2

(12) United States Patent
Wu et al.

(10) Patent No.: US 10,670,280 B2
(45) Date of Patent: Jun. 2, 2020

(54) INDOOR UNIT OF AIR CONDITIONER

(71) Applicant: GREE ELECTRIC APPLIANCES, INC. OF ZHUHAI, Zhuhai, Guangdong (CN)

(72) Inventors: Shaobo Wu, Zhuhai (CN); Weiwei Peng, Zhuhai (CN); Changchun Zhang, Zhuhai (CN); Song Li, Zhuhai (CN); Jianqun Yang, Zhuhai (CN); Yongchao Liang, Zhuhai (CN); Junxiong You, Zhuhai (CN); Huaxiang Xiong, Zhuhai (CN); Anhui Liao, Zhuhai (CN); Yuanju Xu, Zhuhai (CN); Baobao Liu, Zhuhai (CN); Songping Tan, Zhuhai (CN); Xiuying Wu, Zhuhai (CN)

(73) Assignee: GREE ELECTRIC APPLIANCES, INC. OF ZHUHAI, Zhuhai, Guangdong (CN)

( * ) Notice: Subject to any disclaimer, the term of this patent is extended or adjusted under 35 U.S.C. 154(b) by 216 days.

(21) Appl. No.: 15/572,749

(22) PCT Filed: May 6, 2016

(86) PCT No.: PCT/CN2016/081300
§ 371 (c)(1),
(2) Date: Nov. 8, 2017

(87) PCT Pub. No.: WO2016/180281
PCT Pub. Date: Nov. 17, 2016

(65) Prior Publication Data

US 2018/0142906 A1 May 24, 2018

(30) Foreign Application Priority Data

May 8, 2015 (CN) ..... 2015 1 0234245

(51) Int. Cl.
*F24F 1/00* (2019.01)
*F24F 1/02* (2019.01)
(Continued)

(52) U.S. Cl.
CPC ..... *F24F 1/0022* (2013.01); *F24F 1/0003* (2013.01); *F24F 1/0033* (2013.01);
(Continued)

(58) Field of Classification Search
CPC ..... F24F 1/0022; F24F 1/027; F24F 13/20; F24F 13/222; F24F 11/65; F24F 1/0033;
(Continued)

(56) References Cited

U.S. PATENT DOCUMENTS 7,587,908 B2 * 9/2009 Kim ..... F24F 1/0011 62/262
2001/0035021 A1 * 11/2001 Kang ..... F24F 1/027 62/262
(Continued)

FOREIGN PATENT DOCUMENTS

CN 1334424 A 2/2002
CN 202511389 U * 10/2012
(Continued)

OTHER PUBLICATIONS

WIPO, International Search Report dated Aug. 16, 2016.

*Primary Examiner* — Frantz F Jules
*Assistant Examiner* — Martha Tadesse
(74) *Attorney, Agent, or Firm* — Li & Cai Intellectual Property (USA) Office

(57) ABSTRACT

An indoor unit of an air conditioner includes: a bottom shell, at least two air passages (11) are provided abreast in the bottom shell (1); an air passage cover plate (2), provided on the at least two air passages (11) in a covering manner, flow guide openings (21) corresponding to the at least two air
(Continued)

passages (11) are provided in the air passage cover plate (2) respectively; at least two centrifugal fans (3), provided in the at least two air passages (11) respectively and provided opposite to the corresponding flow guide openings (21); and an evaporator (4), provided on a side, far away from the bottom shell (1), of the air passage cover plate (2), each of the flow guide openings (21) is provided opposite to the evaporator (4).

6 Claims, 21 Drawing Sheets

(51) Int. Cl.

| | |
|---|---|
| ***F24F 1/0022*** | (2019.01) |
| ***F24F 11/65*** | (2018.01) |
| ***F24F 1/0033*** | (2019.01) |
| ***F24F 13/20*** | (2006.01) |
| ***F24F 13/08*** | (2006.01) |
| ***F24F 1/0003*** | (2019.01) |
| ***F24F 13/22*** | (2006.01) |
| ***F24F 1/027*** | (2019.01) |

(52) U.S. Cl.
CPC ..... *F24F 1/027* (2013.01); *F24F 11/65* (2018.01); *F24F 13/081* (2013.01); *F24F 13/20* (2013.01); *F24F 13/222* (2013.01); *F24F 2013/205* (2013.01); *F24F 2221/54* (2013.01)

(58) Field of Classification Search
CPC .. F24F 13/081; F24F 1/0003; F24F 2013/205; F24F 2221/54; F24F 1/0018; F24F 1/0057; F24F 1/0011; F24F 13/08
See application file for complete search history.

(56) References Cited

U.S. PATENT DOCUMENTS

| | | | | |
|---|---|---|---|---|
| 2005/0092015 | A1* | 5/2005 | Park | F24F 1/0007 62/419 |
| 2007/0137243 | A1* | 6/2007 | Lee | F04D 29/462 62/419 |
| 2010/0242518 | A1* | 9/2010 | Yang | F24F 1/0007 62/262 |
| 2010/0287966 | A1* | 11/2010 | Cha | F24F 1/0007 62/263 |
| 2014/0131018 | A1* | 5/2014 | Lee | F24F 1/0022 165/121 |

FOREIGN PATENT DOCUMENTS

| | | | | | |
|---|---|---|---|---|---|
| CN | 202511389 | U | | 12/2012 | |
| CN | 104197411 | A | * | 12/2014 | F24F 13/08 |
| CN | 104197411 | A | | 12/2014 | |
| CN | 203980465 | U | | 12/2014 | |
| CN | 104422023 | A | | 3/2015 | |
| CN | 104807096 | A | | 7/2015 | |
| CN | 204648474 | U | | 9/2015 | |
| JP | 2007101171 | A | * | 4/2007 | F24F 1/0057 |
| JP | 2013060916 | A | | 4/2013 | |
| KR | 20040029672 | A | | 4/2004 | |
| KR | 20070038364 | A | * | 4/2007 | F24F 1/0057 |
| KR | 101251557 | B1 | * | 4/2013 | |

* cited by examiner

INDOOR UNIT OF AIR CONDITIONER

TECHNICAL FIELD

The disclosure relates to a field of cooling equipment, and more particularly to an indoor unit of an air conditioner.

BACKGROUND

Most of existing split air conditioners adopt cross-flow air duct systems. There are few wall-mounted air conditioners adopting centrifugal air duct systems, but most of them adopt single centrifugal fans, so there are limited air volumes, increase of cooling and heating capacities of the air conditioners is restricted, meanwhile, the whole air conditioners are heavy, and have many defects, and use of users is affected.

SUMMARY

The disclosure is intended to provide an indoor unit of an air conditioner, so as to solve the problem of restriction of a limited air volume to cooling of the air conditioner in a conventional art.

In order to achieve the purpose, the invention provides an indoor unit of an air conditioner, which comprises: a bottom shell, at least two air passages are provided abreast in the bottom shell; an air passage cover plate, provided on the at least two air passages in a covering manner, flow guide openings corresponding to the at least two air passages are formed in the air passage cover plate respectively; at least two centrifugal fans, provided in the at least two air passages respectively and provided opposite to the corresponding flow guide openings; and an evaporator, provided on a side, far away from the bottom shell, of the air passage cover plate, each of the flow guide opening beings is provided opposite to the evaporator.

Furthermore, each of the centrifugal fans is provided with a flow guide ring, an air inlet opposite to a corresponding flow guide opening is provided in the flow guide ring, a flange for preventing air leakage is formed along an edge of the corresponding flow guide opening, and the flange extends into the air inlet.

Furthermore, each of the centrifugal fans is provided with a flow guide ring, an air inlet opposite to a corresponding flow guide opening is provided in the flow guide ring, an annular air stopping protruding edge protruding towards the air passage cover plate is provided along a circumferential direction of the air inlet, and an air leakage preventing groove matched to the air stopping protruding edge is provided along a circumferential direction of the flow guide opening.

Furthermore, each of the centrifugal fans comprises: a flow guide ring; a blade body plate, provided at interval with the flow guide ring, a hub protruding towards a direction of the flow guide ring and used for covering a fan motor is provided on the blade body plate; and a plurality of fan blades, all mounted between the flow guide ring and the blade body plate, the fan blades are provided along a circumferential direction of the hub.

Furthermore, a vertical plate extending along side edges of the air passages is provided on a side, facing the bottom shell, of the air passage cover plate, and the vertical plate is overlapped with sidewalls of the air passages.

Furthermore, a support rib for supporting the evaporator is provided on a side, far away from the bottom shell, of the air passage cover plate.

Furthermore, each of the air passage is provided with two air outlets, and air outlet directions of the two air outlets are different.

Furthermore, one in the two air outlets of each of the air passages is provided in an upper part of the indoor unit of the air conditioner, and the other is provided in a lower part of the indoor unit of the air conditioner.

Furthermore, the indoor unit further comprises a front panel, the front panel is provided on a side, back on to the bottom shell, of the evaporator, and the front panel can be forwards pushed out.

Furthermore, the indoor unit further comprises a panel body provided between the front panel and the evaporator, and the panel body comprises a frame and a filter net provided on the frame in a covering manner.

Furthermore, a grill is connected along an edge of the front panel, and the grill is provided in a manner of following the front panel.

Furthermore, the evaporator comprises a first heat exchanger, and the first heat exchanger is provided with the flow guide openings in a covering manner; or, the evaporator comprises second heat exchangers, and each of the second heat exchangers is provided at one of the corresponding flow guide openings respectively.

Furthermore, the indoor unit further comprises a base for bearing the evaporator, a placement groove adapted to the evaporator is provided in the base, a bearing platform for bearing the evaporator is provided on a sidewall of the placement groove, and a drain trough is provided in the bearing platform.

Furthermore, the indoor unit further includes a base for bearing the evaporator, a placement groove adapted to the evaporator is provided in the base, a support vertical plate for supporting the evaporator is provided in the placement groove, and the support vertical plate comprises a plurality of support plate segments provided at intervals.

Furthermore, the base is connected to the air passage cover plate, and is positioned on a side, back on to the bottom shell, of the air passage cover plate.

Furthermore, the evaporator comprises an evaporator body; and a bottom frame, provided below the evaporator body, a plurality of drain holes is provided in the bottom frame.

Furthermore, the drain holes are divided into multiple rows of drain holes, and the drain holes in every two adjacent rows are provided in a staggered manner.

Furthermore, the at least two air passages comprise a first air passage and a second air passage adjacent to the first air passage, and an electric box mounting part is provided between the first air passage and the second air passage.

Furthermore, a first upper volute tongue is provided on a side, close to the second air passage, of a first end of the first air duct, a second upper volute tongue is provided on a side, close to the first air passage, of a first end of the second air passage, and the first upper volute tongue and the second upper volute tongue are provided on one side of the electric box mounting part respectively.

Furthermore, the indoor unit further includes a first wiring passage extending from the electric box mounting part to two sides of the electric box mounting part.

Furthermore, the first wiring passage is provided in one side, back on to the bottom shell, of the air passage cover plate.

Furthermore, the indoor unit further comprises a second wiring passage, and the second wiring passage is provided between the first air passage and the second air passage, and extends along the air passages.

Furthermore, the indoor unit further comprises a third wiring passage and a fourth wiring passage, the third wiring passage extends from the second wiring passage to a corresponding centrifugal fan in the first air passage, and the fourth wiring passage extends from the second wiring passage to a corresponding centrifugal fan in the second air passage.

With application of the technical solution of the disclosure, the indoor unit of the air conditioner is provided with multiple air ducts, a fan is arranged in each air duct, and multiple fans are used for heat exchange between a heat exchange unit and an external environment, so that the problem of restriction of a limited air volume to cooling of the air conditioner in the conventional art is solved.

BRIEF DESCRIPTION OF THE DRAWINGS

Specification drawings forming a part of the invention are adopted to provide a further understanding to the invention, and schematic embodiments of the invention and descriptions thereof are adopted to explain the invention and not intended to form improper limits to the invention. In the drawings.

Wherein, the drawings include the following drawing reference signs:

1、bottom shell; 11、air passage; 11*a*、first sidewall; 11*b*、second sidewall; 111、first air passage; 112、second air passage; 121、upper air outlet; 122、lower air outlet; 1211、first upper air outlet; 1212、second upper air outlet; 1221、first lower air outlet; 1222、second lower air outlet; 13、electric box mounting part; 131、electric box; 1321、second wiring passage; 1322、third wiring passage; 1323、fourth wiring passage; 133、first cover plate; 1331、first connecting part; 1332、second connecting part; 134、second cover plate; 1341、third connecting part; 1342、fourth connecting part; 14、motor radiation hole; 151、first upper volute tongue; 152、second upper volute tongue; 153、first lower volute tongue; 154、second lower volute tongue; 16、swing mechanism; 161、first upper swing mechanism; 162、second upper swing mechanism; 163、first lower swing mechanism; 164、second lower swing mechanism; 171、upper air deflector; 173、lower air deflector; 181、air passage bottom surface; 1821、mounting groove bottom surface; 1822、mounting groove sidewall; 2、air passage cover plate; 21、flow guide opening; 211、first flow guide opening; 212、second flow guide opening; 22、first wiring channel; 221、separation plate; 2211、wiring nick; 222、avoiding nick; 23、driving box; 24、air leakage preventing groove; 25、support rid; 26、vertical plate; 3、centrifugal fan; 3*a*、first centrifugal fan; 3*b*、second centrifugal fan; 31、centrifugal impeller; 311、hub; 3111、air vent; 312、air stopping protruding edge; 32、motor gland; 321、first cover body; 322、connecting flange; 323、reinforcing structure; 33、fan motor; 313、blade body plate; 314、flow guide ring; 4、evaporator; 5、base; 51、placement groove; 52、bearing platform; 53、support vertical plate; 54、water diversion pipe; 6、front panel; 61、upper air inlet; 62、lower air inlet; 63、lateral air inlet; 7、panel body; 71、baffle plate accommodating groove; 73

、air inlet grill; 74、frame; 75、filter net; 76、driving mechanism; 81、upper air inlet baffle plate; 82、lower air inlet baffle plate; 9、air outlet baffle plate; 91、upper air outlet baffle plate; 92、lower air outlet baffle plate; 93、stepper motor; 94、retaining step surface; 95、second avoiding groove; and 96、sealing gasket.

DETAILED DESCRIPTION OF THE EMBODIMENTS

It is important to note that the embodiments in the invention and characteristics in the embodiments may be combined without conflicts. The invention will be described below in detail with reference to the drawings and in combination with the embodiments.

Figure 1:
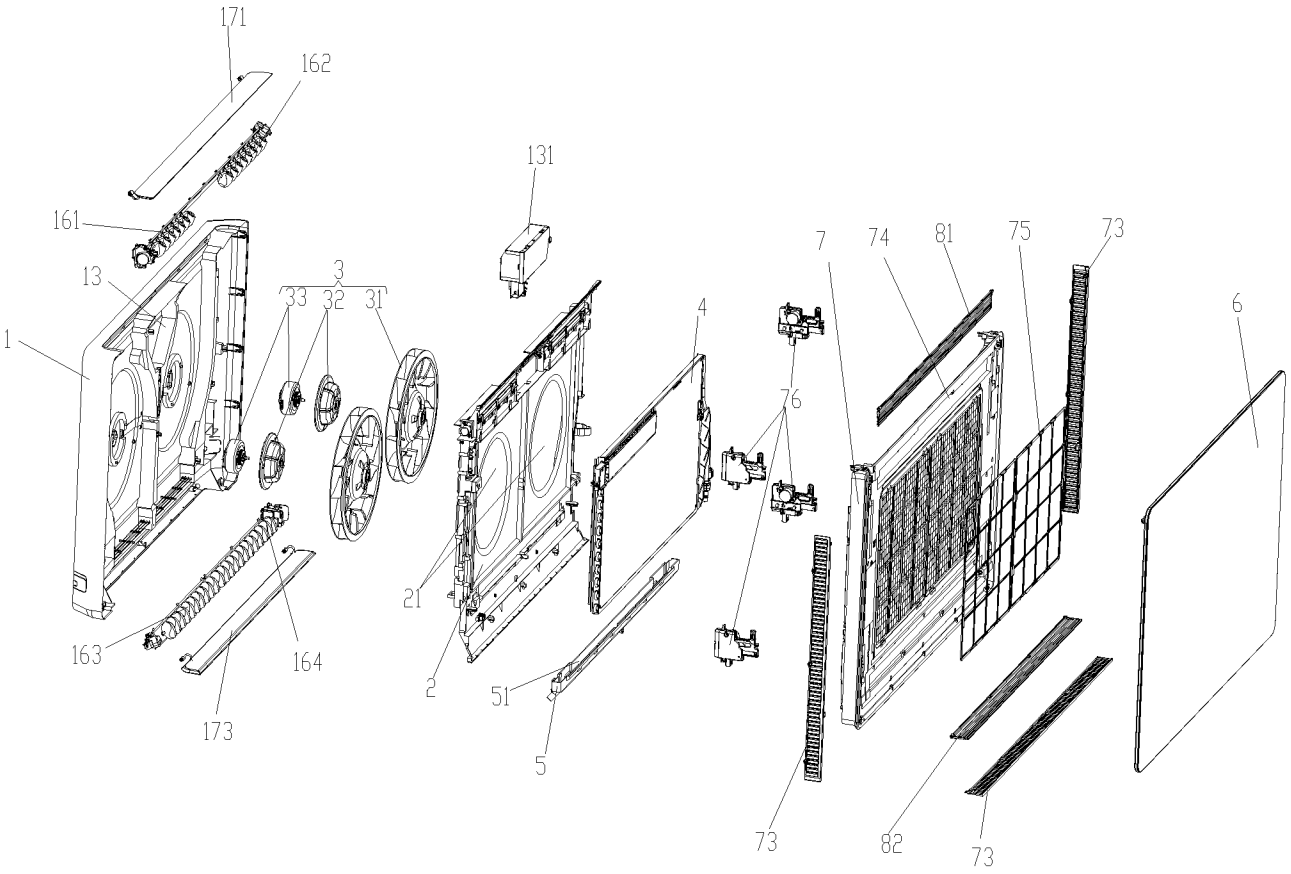
FIG. 1 is an exploded structure diagram of an air conditioner according to an embodiment of the invention.
Figure 9:
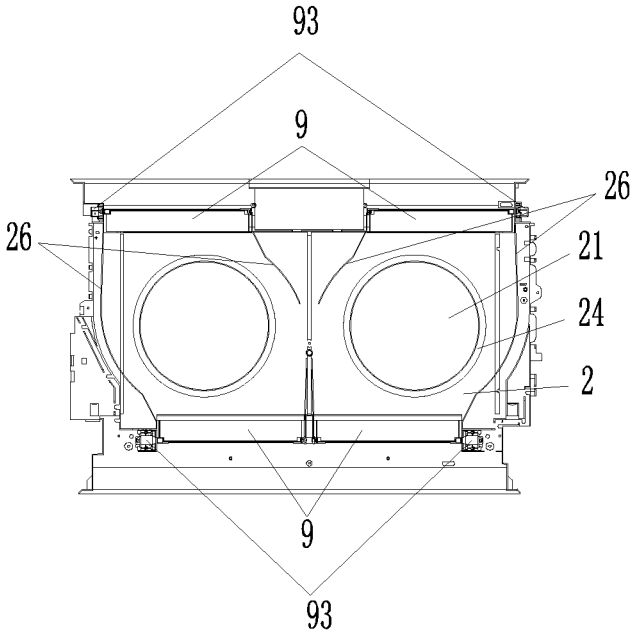
FIG. 9 is a structure diagram of an air passage cover plate and electric box of an air conditioner according to an embodiment of the invention.
Figure 24:
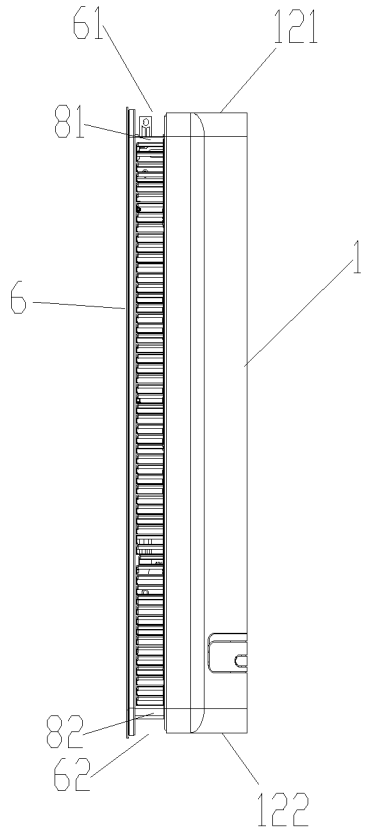
FIG. 24 is a structure diagram of an air conditioner (a front panel is pushed out) according to an embodiment of the invention.

As shown in FIG. 1, FIG. 9 and FIG. 24, an air conditioner of the embodiment comprises a bottom shell 1, a centrifugal fan 3, an air passage cover plate 2, an evaporator 4, a panel body 7, a front panel 6, an upper air inlet baffle plate 81, a lower air inlet baffle plate 82 and an air outlet baffle plate 9 which are sequentially arranged. The structures will be introduced below one by one.

As shown in FIG. 2 to FIG. 8 and FIG. 25, the bottom shell 1 is provided with an upper side and a lower side which are provided opposite to each other, an air passage 11 extending from the upper side to the lower side is provided in the bottom shell 1, the air passage 11 is provided with an upper air outlet 121 corresponding to the upper side and a lower air outlet 122 corresponding to the lower side, an upper air deflector 171 and an upper swing mechanism are provided at an upper air outlet 121, and a lower air deflector 173 and a lower swing mechanism are provided at the lower air outlet 122. The upper air outlet 121 blows air upwards, and the lower air outlet 122 blow air downwards. In such a manner, a user may regulate air to be blown through the upper air outlet 121 and/or the lower air outlet 122 according to a practical requirement, and regulation amplitudes of the air outlet directions are further increased, thereby improving comfort of the user. A motor radiation hole 14 is provided in the bottom shell 1, and specific structures and functions of the motor radiation hole 14 will be described later in detail.

Figure 10:
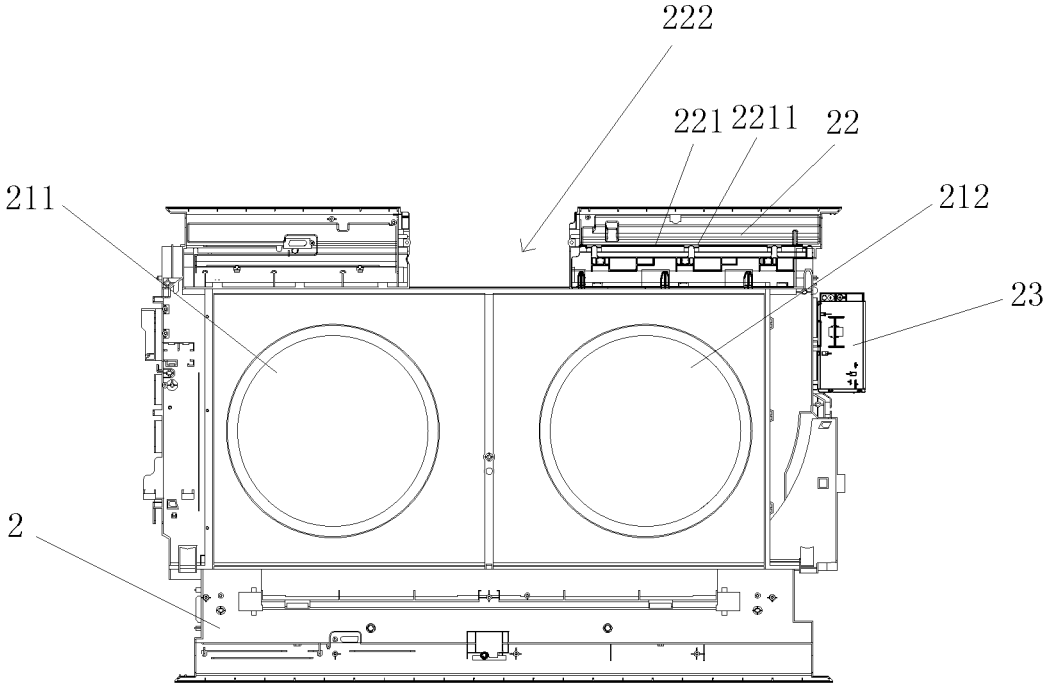
FIG. 10 is a structure diagram of an air passage cover plate of an air conditioner according to an embodiment of the invention.

As shown in FIG. 9 and FIG. 10, the air passage cover plate 2 is provided with a flow guide opening 21 communicated with a corresponding air passage 11. A specific structure and function of the air passage cover plate 2 will be described later in detail.

As shown in FIG. 1, FIG. 7, FIG. 7*a* and FIG. 8, the centrifugal fans 3 are provided in the air passages respectively. Each of the centrifugal fans 3 comprises a fan motor 33 and a centrifugal impeller 31 driven by the fan motor 33, and the centrifugal impeller 31 is provided with a blade body plate 313. Specific structures and positional relationships of the centrifugal fans 3 will be described later in detail.

As shown in FIG. 1, the evaporator 4 is provided on a side, far away from the bottom shell 1, of the centrifugal fans 3. In the embodiment, the evaporator 4 covers all the flow guide openings 21. Or in other implementation modes, an evaporator is correspondingly provided at each of the flow guide openings 21.

Figure 26:
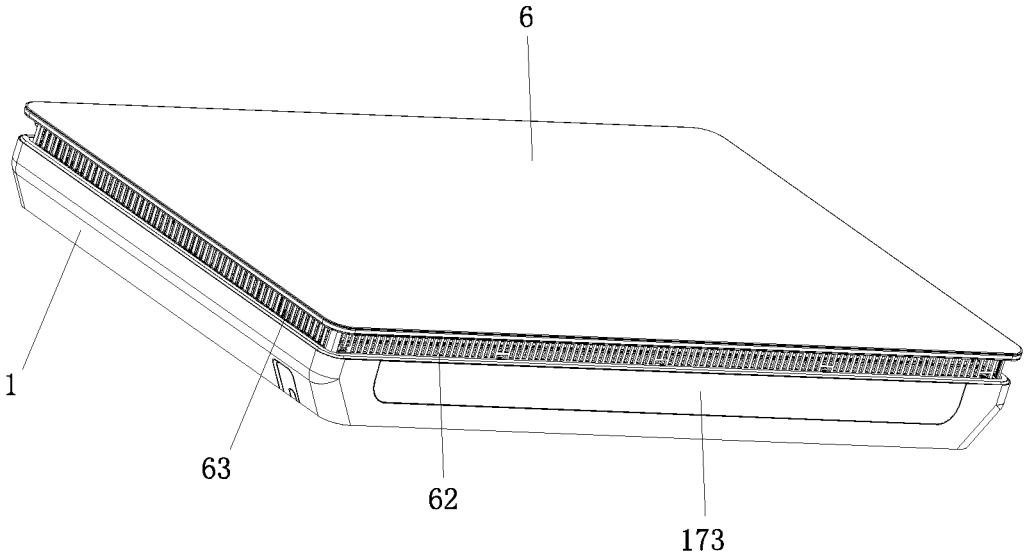
FIG. 26 is a three-dimensional structure diagram of an air conditioner (a front panel is pushed out) according to an embodiment of the invention.

As shown in FIG. 1, FIG. 24 and FIG. 26, the front panel 6 is movably provided on the bottom shell 1, the front panel 6 preferably has an opening position far away from the bottom shell 1 and a closing position close to the bottom shell 1, and when the front panel 6 is at the opening position, an air inlet is formed between the front panel 6 and the bottom shell 1, wherein the air inlet comprises an upper air inlet 61, a lower air inlet 62 and a lateral air inlet 63 formed between the upper air inlet 61 and the lower air inlet 62. Furthermore, the upper air inlet 61 and the lower air inlet 62 are formed between the air passage cover plate 2 and the front panel 6. Preferably, a position of the front panel 6 and the air passage cover plate 2 is adjustably connected. Since the position of the front panel 6 and the air passage cover plate 2 is adjustably connected, a distance between the front panel 6 and the air passage cover plate 2 is changed to regulate a size of the air inlet to further endow the characteristic of adjustability of an inlet air volume within a unit time to the air conditioner and make the air conditioner thinner. Of course, the front panel 6 is also fixedly provided on the bottom shell 1, and the air inlet is formed between the front panel 6 and the bottom shell 1. The panel body 7 comprises a frame and a filter net 75 provided on the frame 74 in a covering manner. The condition that impurities enter an indoor unit of the air conditioner to hinder normal work of the indoor unit of the air conditioner is favorably avoided, and a probability of occurrence of a failure of the indoor unit of the air conditioner is favorably reduced.

As shown in FIG. 24, the upper air inlet baffle plate 81 is correspondingly provided at the upper air inlet 61, and is used for covering or opening the upper air inlet 61. The lower air inlet baffle plate 82 is correspondingly provided at the lower air inlet 62, and is used for covering or opening the lower air inlet 62. When the air conditioner is in an upward air blowing state, the upper air inlet baffle plate 81 overshadows the upper air inlet 61, and when the air conditioner is in a downward air blowing state, the lower air inlet baffle plate 82 overshadows the lower air inlet 62. With arrangement of the upper air inlet baffle plate 81 and the lower air inlet baffle plate 82, when corresponding exhaust outlets exhaust air, the corresponding air inlet baffle plates is closed to effectively avoid the exhausted air flowing back, thereby effectively improving a heat exchange effect of the air conditioner, remarkably improving energy efficiency of the air conditioner and endowing the characteristics of low energy consumption and high running performance to the air conditioner. Specific structures and connecting relationships of the upper air inlet baffle plate 81 and the lower air inlet baffle plate 82 will be described later in detail.

As shown in FIG. 9, FIG. 16, FIG. 18 and FIG. 25, a pivotal air outlet baffle plate 9 is correspondingly provided at each of the air outlets, and the air outlet baffle plate 9 has a first position avoiding the corresponding air passage 11 and a second position sealing the corresponding air outlet. The user may regulate air to be blown through a specific air outlet according to the practical requirement, and the regulation amplitude of the air outlet directions is increased, thereby improving the comfort of the user. In the embodiment, the air outlet baffle plate comprises an upper air outlet baffle plate 91 and a lower air outlet baffle plate 92, the upper air outlet baffle plate 91 is provided corresponding to the upper air outlet 121, the lower air outlet baffle plate 92 is provided corresponding to the lower air outlet 122, the upper air outlet baffle plate 91 may avoid the upper air outlet 121 or seal the upper air outlet 122 in a pivoting manner, and the lower air outlet baffle plate 92 may avoid the lower air outlet 122 or seal the lower air outlet 122 in the pivoting manner. By such a structure, the upper air outlet 121 or the lower air outlet 122 is sealed according to the requirement of the user. When the air conditioner is in the upward air blowing state, in this state, the lower air outlet baffle plate 92 pivots to the positions sealing the lower air outlet 122, the upper air outlet baffle plate 91 is at the positions avoiding the upper air outlets 121, and at this moment, the air conditioner blows air only through the upper air outlet 121. Similarly, air may also be blown only through the lower air outlet 122 or air may be blown through both the upper air outlet 121 and the lower air outlet 122. Specific structures and connecting relationships of the air outlet baffle plates 9 will be described later in detail.

The specific structures and functions of the motor radiation hole 14 will be described below in detail.

Figure 2:
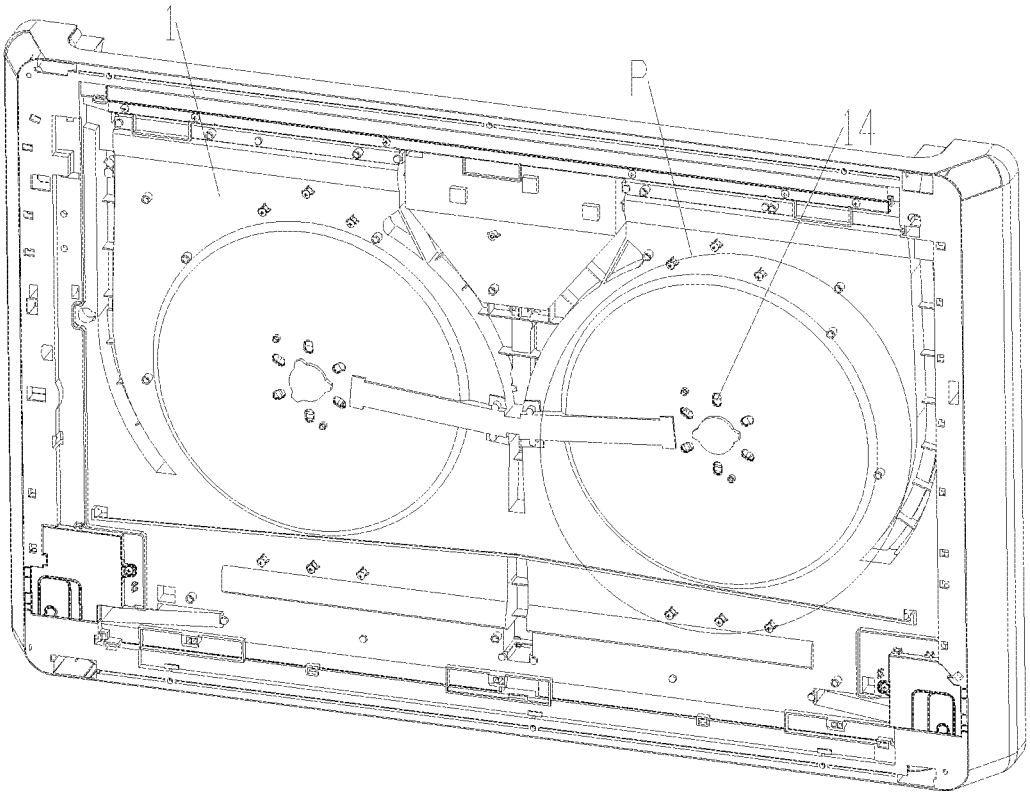
FIG. 2 is a three-dimensional structure diagram of a bottom shell of an air conditioner according to an embodiment of the invention.
Figure 8:
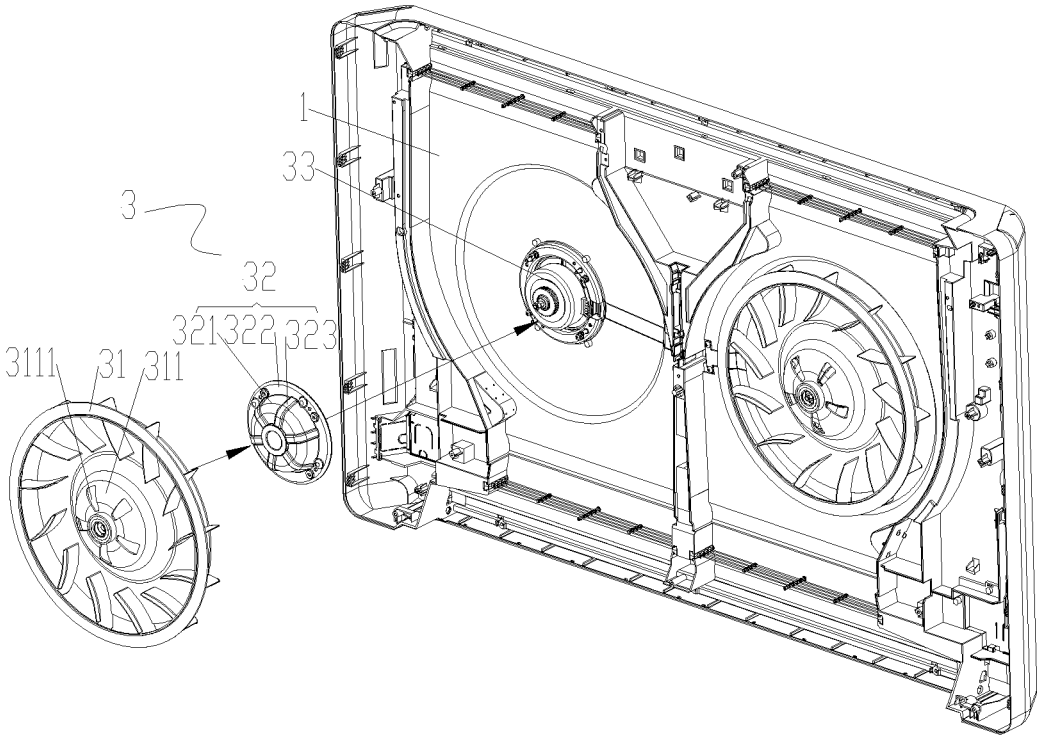
FIG. 8 is an exploded structure diagram of a bottom shell of an air conditioner and centrifugal fans mounted on the bottom shell according to an embodiment of the invention.

As shown in FIG. 2 and FIG. 8, the motor radiation hole 14 are formed in positions corresponding to the fan motors 33 on the bottom shell 1. Since the motor radiation hole 14 are provided in the bottom shell 1, that is, heat energy of the fan motors 33 is dissipated through the motor radiation hole 14 in the bottom shell 1 in a manner of dissipating heat from the side of the bottom shell 1, so that dissipate heat effects of the fan motors 33 may be ensured no matter whether the air conditioner is in a heating or cooling mode, and influence of mode switching on radiation of the fan motors 33 is eliminated. Therefore, radiation reliability of the fan motors 33 is effectively improved, radiation stability of the fan motors 33 is ensured, and the fan motors 33 are reduced in running temperature, high in working efficiency, low in energy consumption and long in service life.

In the invention, the air passages 11 are formed in the bottom shell 1. The air conditioner further comprises a motor gland 32 for isolating a housing of each of the fan motor 33 from the corresponding air passage 11, and the motor gland 32 is provided outside the fan motor 33 in a covering manner, and is connected with the bottom shell 1. Since the motor gland 32 is provided outside the corresponding fan motor 33 in the covering manner, that is, the fan motors 33 are isolated from the air passage 11, so that influence of a temperature of air in the air passage 11 on the fan motor 33 is eliminated. In addition, the radiation reliability of the fan motor 33 is ensured through the motor radiation hole 14 in the bottom shell 1, so that stability of running temperatures of the fan motor 33 is ensured.

In a preferred implementation mode shown in FIG. 8, the motor gland 32 comprises a first cover body 321 and a connecting flange 322, the first cover body 321 is provided outside the housing of the fan motor 33 in the covering manner, the connecting flange 322 is provided at an open end of the first cover body 321, and the connecting flange 322 is in face matched with the bottom shell 1. With arrangement of the first cover bodies 321, it is ensured that the fan motors 33 may be stably mounted on the bottom shell 1, and meanwhile, the fan motors 33 are effectively isolated from the air passage 11, so that running reliability of the fan motors 33 is ensured. With arrangement of the connecting flanges 322, connecting reliability of the first cover body 321 and the bottom shell 1 is ensured. In addition, the connecting flange 322 is in face matched with the bottom shell 1, so that contact areas therebetween are enlarged, and local stress concentration is effectively reduced.

Preferably, the motor gland 32 further comprises a reinforcing structure 323, and the reinforcing structure 323 is provided on the first cover body 321. The reinforcing structure 323 is provided on the first cover body 321, so that overall structural strength of the motor gland 32 is strengthened, and operational reliability of the motor gland 32 is effectively improved.

As shown in FIG. 8, the reinforcing structure 323 comprises one or more reinforcing ribs, the reinforcing ribs extend to the open end of the corresponding first cover body 321 along a center of the cover body, and the multiple reinforcing ribs are provided at intervals. Of course, the reinforcing ribs may also be annularly provided on the first cover body 321.

In a preferred implementation mode which is not shown, the air conditioner further comprises a fan motor fixing bracket, the fan motor fixing bracket is crimped outside the corresponding fan motor 33, and is connected with the bottom shell 1, and a first ventilation structure is provided on the fan motor fixing bracket. The motor radiation hole 14 are formed in the bottom shell 1, and then heat on the corresponding fan motor 33 may also be dissipated into an external environment through the motor radiation hole 14 even though the air in the air passage 11 may influence the corresponding fan motor 33 through the first ventilation structure, so that the radiation reliability of the fan motor and diversity of radiation manners are ensured. Particularly in the cooling mode, cold air in the air passage 11 may cool the fan motor 33, thereby avoiding the fan motor 33 being overheated and ensuring running stability and reliability of the fan motor 33.

Preferably, the air conditioner further comprises a second cover body, the second cover body is provided on the fan motor fixing bracket in a rotating manner, and the second cover body is provided with a second ventilation structure. The second cover body has a first working position and a second working position. When the second cover body is at the first working position, the first ventilation structure and the second ventilation structure are communicated and so that the air passage 11 is communicated with the corresponding fan motor 33; and when the second cover body is at the second working position, the first ventilation structure and the second ventilation structure are provided in a staggered manner to isolate the air passage 11 from the fan motor 33. With arrangement of the second cover body with the second ventilation structure, the working positions of the second cover body is changed to implement switching of an isolated or communicated state between the fan motor 33 and the air passage 11, so that the radiation manners for the fan motor 33 may be selectively controlled when the air conditioner is in different modes.

Specifically, the air conditioner has two working modes, comprising a cooling mode and a heating mode. When the air conditioner is in the cooling mode, the second cover body is at the first working position; and when the air conditioner is in the heating mode, the second cover body is at the second working position.

When the air conditioner is in the cooling mode, the cold air in the air passage 11 may function to cool the fan motor 33 at this moment, thereby ensuring that the fan motor 33 is in a normal running state in a manner of combining radiation from the side of the bottom shell 1 and cold air radiation.

When the air conditioner is in the heating mode, hot air in the air passage 11 may further increase temperature of the corresponding fan motor 33 at this moment, and it is necessary to isolate the fan motor 33 from the air passage 11 to avoid influence of the hot air on the fan motor 33, thereby radiating the fan motor 33 only through the motor radiation hole 14 in the bottom shell 1 to ensure that the fan motor 33 is in the normal running state.

Figure 3:
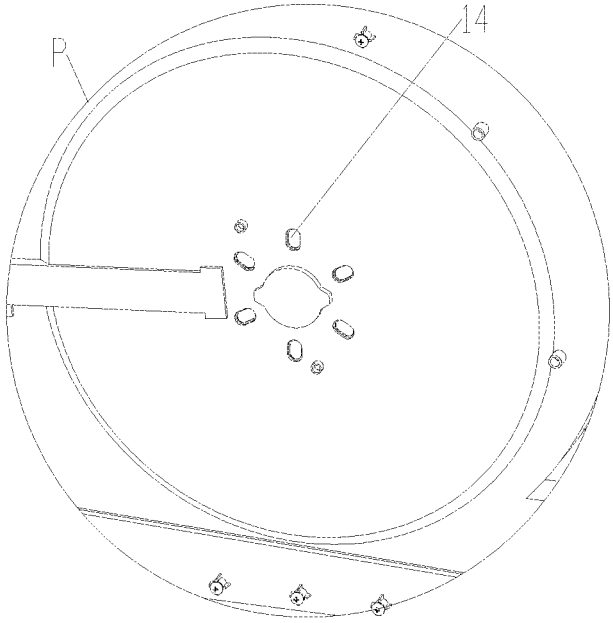
FIG. 3 is an enlarged structure diagram of a part P in FIG. 2.

As shown in FIG. 2 and FIG. 3, the motor radiation hole 14 is a waist-shaped hole or a round. When the motor radiation hole 14 is s waist-shaped hole, compared with round motor radiation hole 14, a forming area of the motor radiation hole 14 is effectively enlarged, thereby improving radiation effects of the motor radiation hole 14.

Of course, the motor radiation hole 14 is also formed into a polygon, ellipse, irregular geometric shape or the like.

In a preferred implementation mode shown in FIG. 2 and FIG. 3, there are a plurality of motor radiation holes 14, the motor radiation holes 14 are formed at intervals along a circumferential direction of the corresponding fan motor 33, and long diameters of the waist-shaped motor radiation holes 14 are provided along a radial direction of the fan motor 33. There are multiple motor radiation holes 14, so that radiation efficiency of the fan motor 33 is effectively improved, and the radiation reliability of the air conditioner is ensured. When the long diameters of the waist-shaped motor radiation holes 14 are provided along the radial direction of the fan motor 33, sufficient radiation areas is ensured, meanwhile, a radiation effect of the fan motor 33 is high in consistency, and the fan motor 33 is prevented from being locally overheated, so that the running reliability of the fan motor 33 is improved.

Preferably, the air conditioner further comprises a centrifugal impeller 31, a hub 311 of the centrifugal impeller 31 is sealed arc-shaped structure, and the hub 311 of the centrifugal impeller 31 is provided outside the fan motor 33 in the covering manner to reduce communication areas between the air passage 11 and the fan motor 33. The hub 311 of the centrifugal impeller 31 is sealed arc-shaped structure, so that the communication areas between the air passage 11 and the fan motor 33 is reduced by own isolation function of the centrifugal impeller 31 to further reduce influence of the temperature of the air in the air passage 11 on the fan motor 33 and ensure the running reliability of the fan motor 33.

Of course, in another preferred implementation mode, the air conditioner further comprises a centrifugal impeller 31, and a hub 311 of the centrifugal impeller 31 is provided with an air vent 3111. The hub 311 of the centrifugal impeller 31 is provided with the air vent 3111, so that the communication area between the air passage 11 and the fan motor 33 is enlarged, and when the air conditioner is in the cooling mode, the cold air in the air passage 11 may further function to cool the fan motor 33 to improve the radiation reliability of the fan motor 33.

The specific structure and function of the air passage cover plate 2 will be described below in detail.

Figure 14:
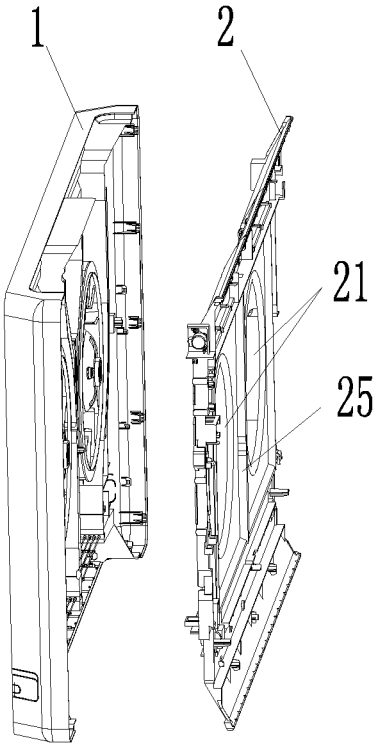
FIG. 14 is a structure diagram of a bottom shell and air passage cover plate of an air conditioner according to an embodiment of the invention.
Figure 16:
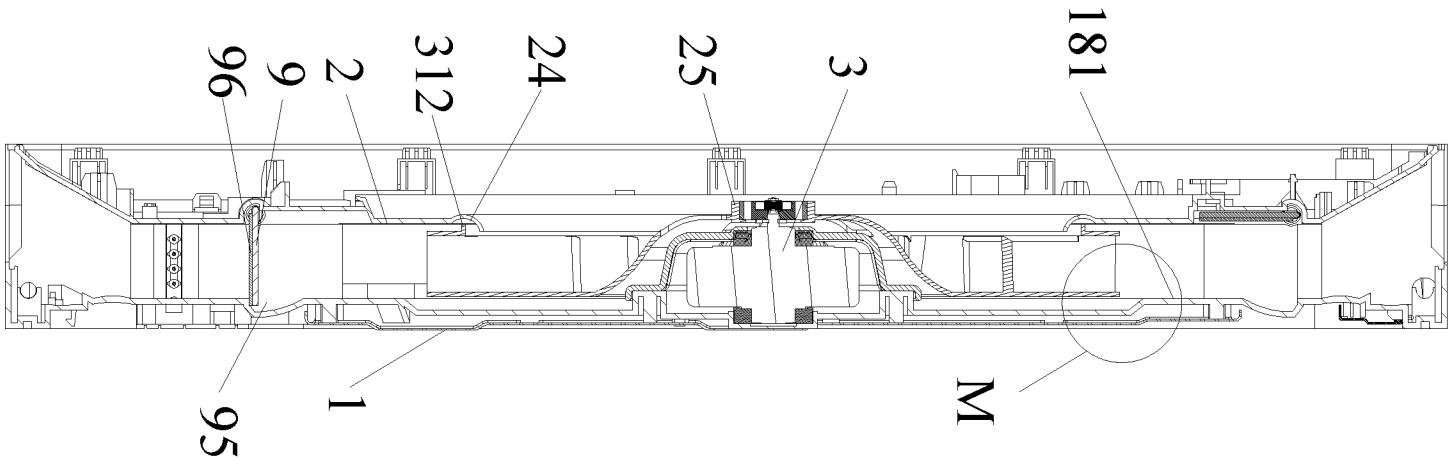
FIG. 16 is a sectional structure diagram of a part A-A in FIG. 15.

As shown in FIG. 9, a vertical plate 26 extending along a side edge of the air passages 11 is provided on a side, facing the bottom shell 1, of the air passage cover plate 2, and the vertical plate 26 is overlapped with sidewalls of the air passages 11. The vertical plate 26 is overlapped with and pressed against the sidewalls of the air passage 11 to prevent air leakage of the air passage 11. In the invention, a support rib 25 for supporting the evaporator is provided on a side, far away from the bottom shell 1, of the air passage cover plate 2. With arrangement of the support rib 25, mounting reliability of the evaporator is ensured, and a contact area between the evaporator and the air passage cover plate 2 is enlarged to effectively avoid the evaporator swaying and vibrating and improve arrangement stability and running reliability of the evaporator. As shown in FIG. 14 and FIG. 16, the support rib 25 is positioned in middle of the air passage cover plate 2. Preferably, the support rib 25 is provided between the two flow guide openings 21. The evaporator is relatively heavy in mass and relatively large in size, so that arranging the support rib 25 in middle of the air passage cover plate 2 may ensure placement reliability of the evaporator and also strengthen overall structural strength of the air passage cover plate 2 to further improve the running reliability and stability of the air conditioner.

The specific structure and positional relationship of the centrifugal fan 3 will be described below in detail.

As shown in FIG. 4 to FIG. 7, FIG. 16 and FIG. 17, the bottom shell 1 is provided with an air passage bottom surface 181 and a mounting groove for mounting the centrifugal fan 3, the air duct bottom surface 181 is provided on a circumferential outer side of the mounting groove, the fan motor 33 is provided in the mounting groove, and the blade body plate 313 is higher than or flush with the air duct bottom surface 181.

The air conditioner comprises the bottom shell 1 and the centrifugal fan 3. The air passage and an air outlet matched with the centrifugal fan 3 are provided on the bottom shell 1, and the centrifugal fan 3 is provided in the air passage. The air conditioner of the embodiment adopts the centrifugal fan 3, and compared with cross-flow fan blades of the prior art, the centrifugal fan 3 has thinner size in a thickness direction of the air conditioner, so that a thickness of the air conditioner may be effectively reduced. In addition, the bottom shell 1 is provided with the mounting groove for mounting the centrifugal fan 3, and formation of the mounting groove may further reduce the thickness of the air conditioner to make the air conditioner thinner. In the invention, the centrifugal fan 3 is provided with the blade body plate 313, the bottom shell 1 is provided with the air passage bottom surface 181 provided on the circumferential outer side of the mounting groove, and the blade body plate 313 protrudes from the air passage bottom surface 181. When the centrifugal fan 3 blow air, the air may be blown outwards above the blade body plate 313, the air leaving the blade body plate 313 may reach the air passage bottom surface 181, and protrusion of the blade body plate 313 from the air passage bottom surface 181 makes resistance of the blade body plate 313 to the air lower to further ensure that the air conditioner may achieve a relatively large outlet air volume. From the above, it can be seen that the air conditioner of the invention solves a thickness problem, also effectively ensures the outlet air volume and provides a better user experience.

In embodiment 1, the mounting groove comprises a mounting groove bottom surface 1821 and a mounting groove sidewall 1822, and the mounting groove sidewall 1822 extend in a manner of gradually enlarging in a direction from the mounting groove bottom surface 1821 to the air passage bottom surface 181. Such a structure makes air outlet resistance lower and further better ensures the outlet air volume.

Figure 17:
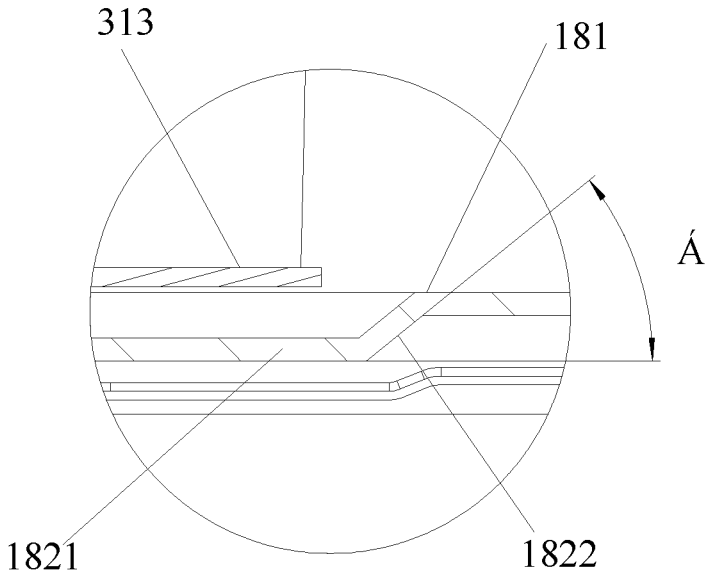
FIG. 17 is an enlarged structure diagram of a part M in FIG. 16.

As shown in FIG. 17, in embodiment 1, a generatrix of the mounting groove sidewall 1822 form an acute included angle $\alpha$ with the mounting groove bottom surface 1821. Such a structure is convenient to machine, manufacture, mount and overhaul, and meanwhile, such a structure may ensure relatively low air outlet resistance.

The acute included angle preferably ranges from 40° to 50°. As shown in FIG. 17, in the embodiment, the included angles $\alpha$ between the generatrix of the mounting groove sidewall 1822 and the mounting groove bottom surface 1821 are 45°, and such an angle ensures simplicity for manufacturing and easiness for implementation, and is favorable for achieving a cushioning effect for guiding the air to flow.

Figure 15:
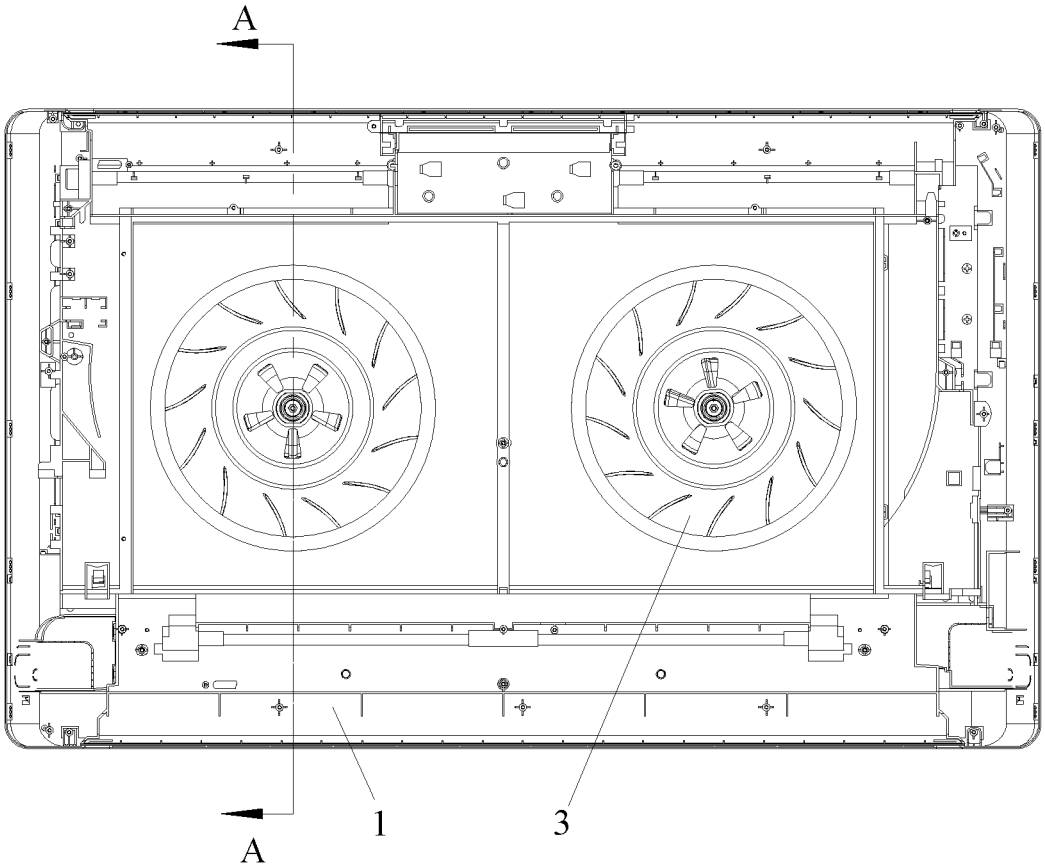
FIG. 15 is a structure diagram after a bottom shell, air passage cover plate and centrifugal fans of an air conditioner are mounted together according to an embodiment of the invention.

As shown in FIG. 15 and FIG. 16, in embodiment 1, a diameter of the mounting groove bottom surface 1821 is larger than an external diameter of the centrifugal fan 3. This ensures that the centrifugal fan 3 smoothly rotate in spaces where they are.

As shown in FIG. 15, in embodiment 1, there are two air passages, the two air passages are formed abreast, and meanwhile, there are also arranged two centrifugal fans 3 corresponding to the air passages respectively. Arrangement of the two air passages and the corresponding centrifugal fans 3 may ensure the outlet air volume on one hand and prevent a space occupied by the air conditioner from being excessively enlarged on the other hand. Of course, there may also be arranged three or more than three air passages and centrifugal fans 3 according to a requirement.

Figure 7:
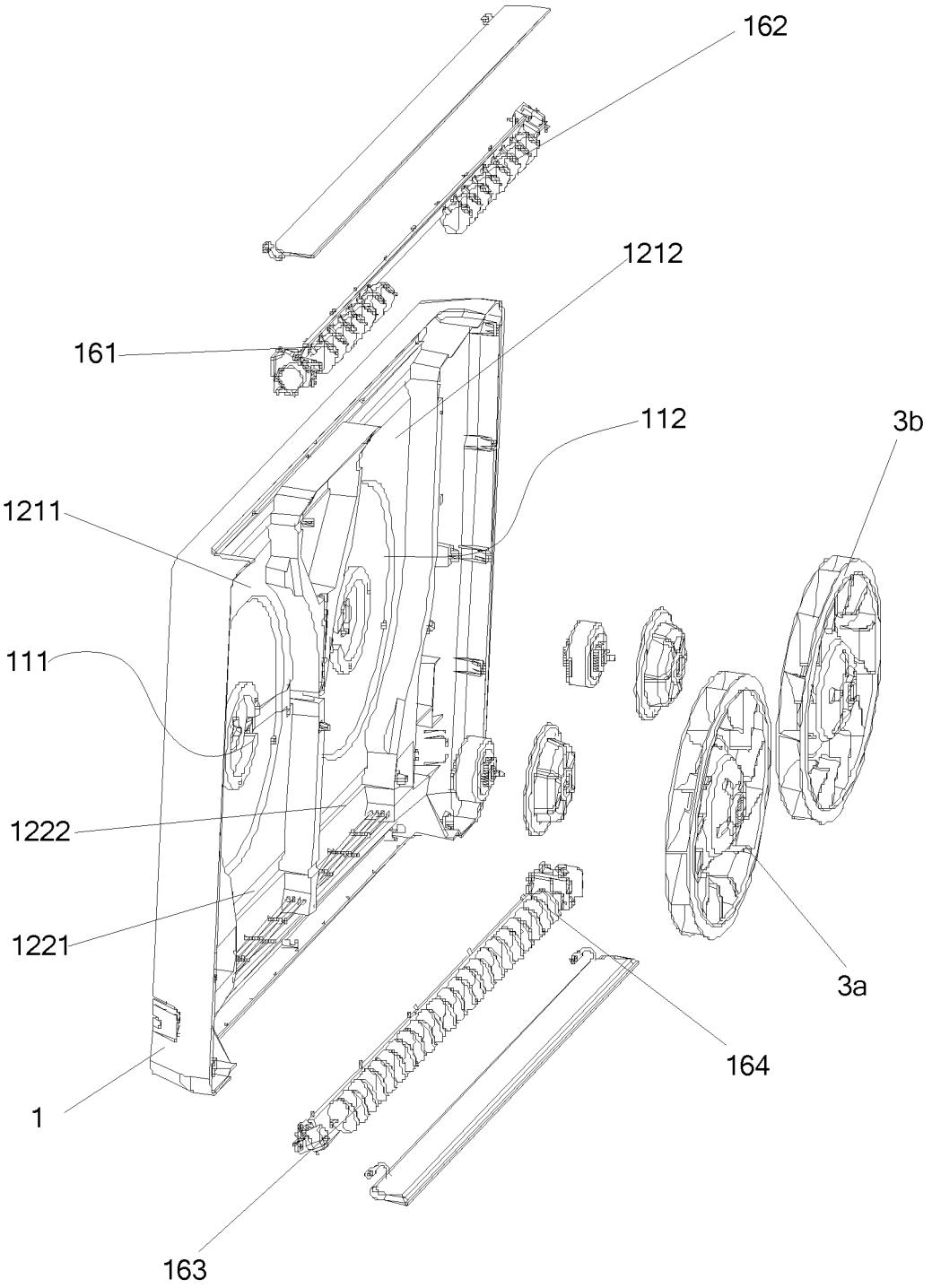
FIG. 7 is an exploded structure diagram of FIG. 6.
Figure 7A:
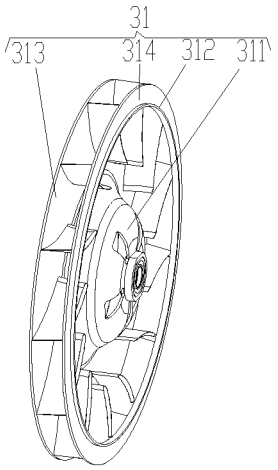
FIG. 7*a* is a structure diagram of a centrifugal impeller of a centrifugal fan of an air conditioner according to an embodiment of the invention.

As shown in FIG. 1 and FIG. 7, preferably, the fans are centrifugal fans. Each of the centrifugal fans comprises a flow guide ring 314; a blade body plate 313, provided at intervals with the flow guide ring 314, a bump protruding towards direction of the flow guide ring 314 is provided on the blade body plate 313 and a motor accommodating cavity is formed in the bump; and a plurality of fan blades, all mounted between the flow guide ring 314 and the blade body plate 313, the fan blades are provided along a circumferential direction of the bump.

The bump protruding towards the flow guide ring 314 is formed in a middle of the blade body plate 313, the motor accommodating cavity of which opening is positioned in a surface, back on to the flow guide ring 314, of the blade body plate 313, is formed in the bump, the fan blades are evenly provided in the circumferential direction of the bump, and the motor is provided between the flow guide ring 314 and the blade body plate 313, so that a thickness of the indoor unit of the air conditioner is reduced, and the space occupied by the air conditioner is further reduced.

The specific structures and connecting relationships of the upper air inlet baffle plate 81 and the lower air inlet baffle plate 82 will be described below in detail.

Figure 23:
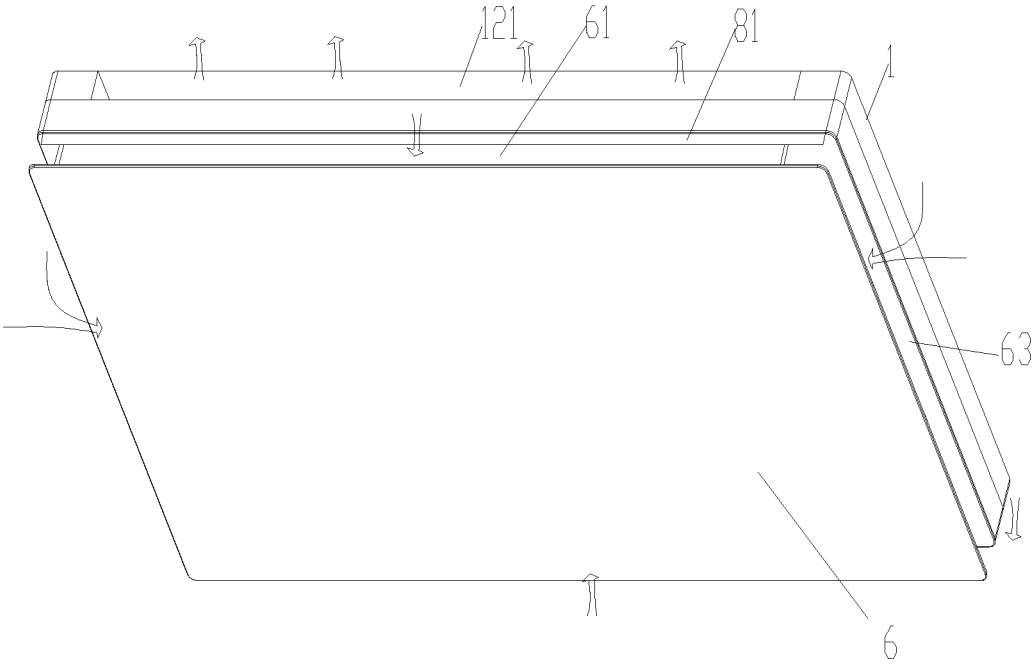
FIG. 23 is a structure diagram of an air conditioner (a front panel is not pushed out) according to an embodiment of the invention.
Figure 25:
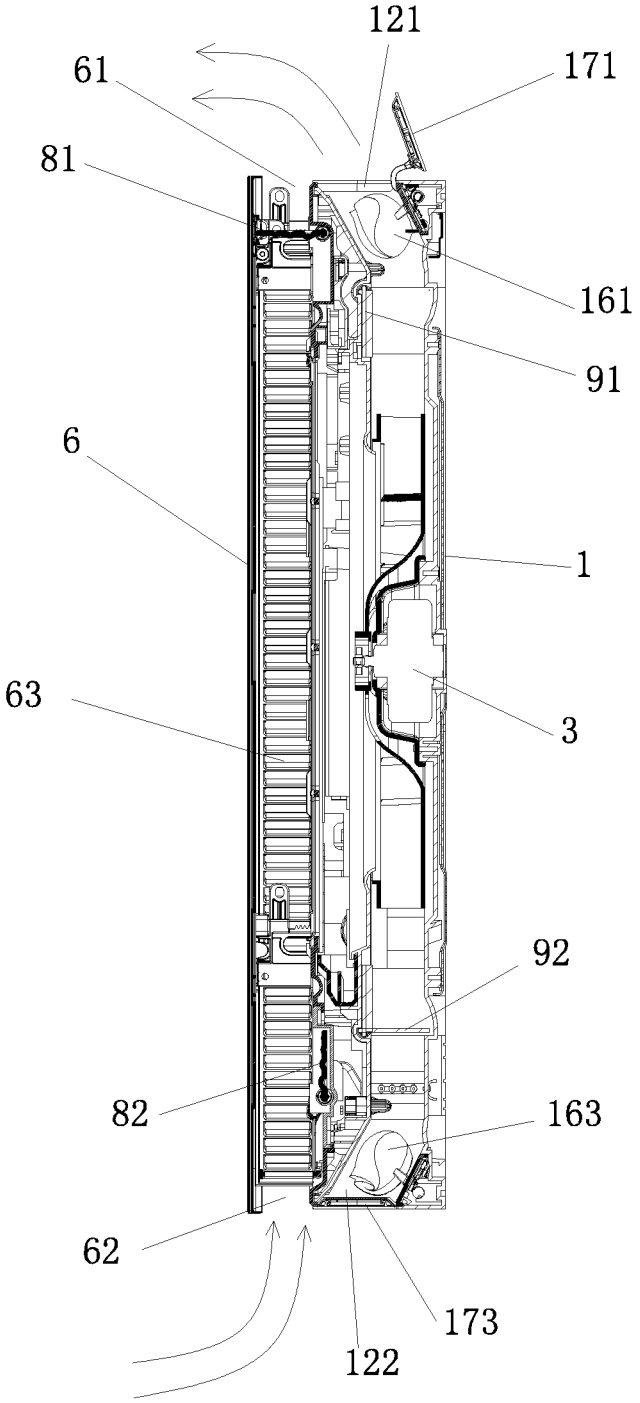
FIG. 25 is a sectional structure diagram of FIG. 24.

As shown in FIG. 23 to FIG. 25, specifically, the upper air inlet baffle plate 81 and the lower air inlet baffle plate 82 have the following working states: when the upper air outlet 121 and the lower air outlet 122 both blow air, the upper air inlet baffle plate 81 and the lower air inlet baffle plate 82 cover the upper air inlet 61 and the lower air inlet 62 respectively; and/or when only the upper air outlet 121 blow air, only the upper air inlet baffle plate 81 covers the upper air inlet 61; and/or when only the lower air outlet 122 blow air, only the lower air inlet baffle plate 82 covers the lower air inlet 62.

It is important to note here that the air conditioner is also required to be ensured to have a sufficient inlet air volume at the same time of preventing the exhausted air from flowing back, otherwise the heat exchange effect and energy efficiency of the air conditioner may still be reduced. Therefore, in the invention, only when the upper air outlet 121 and the lower air outlet 122 both blow air, the upper air inlet baffle plate 81 and lower air inlet baffle plate 82 of the air conditioner are both closed, otherwise the air inlet baffle plates corresponding to air exhausting may be selectively closed. When the upper air outlet 121 and the lower air outlet 122 are both closed, inlet air is required to be ensured by virtue of the lateral air inlet 63.

The upper air inlet baffle plate 81 and the lower air inlet baffle plate 82 are provided between the front panel 6 and the air passage cover plate 2 in an overturning manner. The upper air inlet baffle plate 81 and the lower air inlet baffle plate 82 are provided between the front panel 6 and the air duct cover plate 2 in the overturning manner, so that the working states of the upper air inlet baffle plate 81 and the lower air inlet baffle plate 82 may be controlled to meet return air prevention requirements of different air outlet modes.

Figure 22:
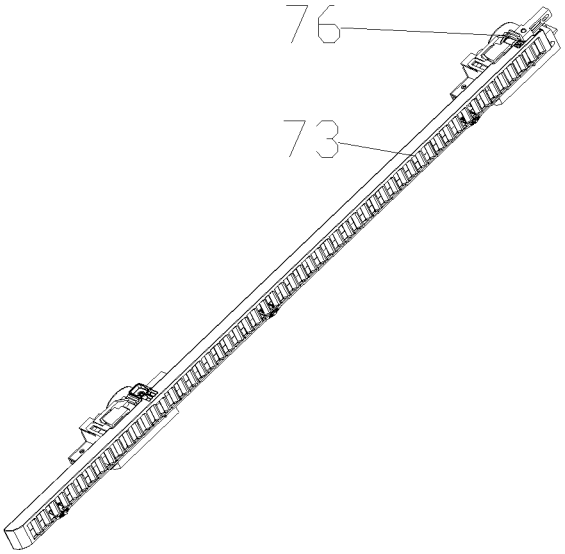
FIG. 22 is a structure diagram of a driving structure and an air inlet grill of an air conditioner according to an embodiment of the invention.

As shown in FIG. 22, the air conditioner of the embodiment further comprises a driving mechanism 76, the front panel 6 is in driving connection with the driving mechanism 76, and the driving mechanism 76 pushes out the front panel 6 forwards to form the air inlets. The front panel 6 is pushed out forwards to form the air inlets, so that air inlet and outlet modes of the air conditioner are optimized. Placement parts protruding towards a direction of the bottom shell 1 are provided on two sides of the panel body 7, and the placement parts are provided to accommodate the driving mechanism 76. The placement parts for placing the driving mechanism 76 are provided in form of protruding towards the bottom shell 1, so that the thickness of the indoor unit of the air conditioner is favorably reduced, and the space is fully utilized.

Preferably, a first side of the upper air inlet baffle plate 81 is pivotally connected with the front panel 6 or the air passage cover plate 2, and a second side of the upper air inlet baffle plate 81 is a free side. The upper air inlet baffle plate 81 is pivotally connected with the front panel 6 and/or the air passage cover plate 2, so that movement reliability and accommodation reliability of the upper air inlet baffle plate 81 are improved. When the upper air inlet baffle plate 81 is in a folded state of not stopping air, the upper air inlet baffle plate 81 may be closely attached to the air passage cover plate 2 or the front panel 6 to avoid the upper air inlet 61, thereby ensuring air inlet reliability of the air conditioner.

Similarly, the connecting relationship between the lower air inlet baffle plate 82 and the front panel 6 and/or the air passage cover plate 2 is similar to the connecting relationship between the upper air inlet baffle plate 81 and the front panel 6 and/or the air passage cover plate 2, and will not be elaborated herein.

In a specific embodiment, the first side of the upper air inlet baffle plate 81 is pivotally connected with the air passage cover plate 2, an air inlet sealing structure is provided on a surface of the side, facing the air passage cover plate 2, of the front panel 6, and the second side of the upper air inlet baffle plate 81 is in sealing fit with the air inlet sealing structure. With arrangement of the air inlet sealing structure in sealing fit with the second side of the upper air inlet baffle plate 81, return air prevention reliability of the upper air inlet baffle plate 81 is ensured, thereby solving the problem of backflow caused by air leakage. Of course, such an air inlet sealing structure may also be provided at a position corresponding to the lower air inlet baffle plate 82 on the front panel 6.

Preferably, the air inlet sealing structure comprises an air inlet sealing protruding rib or an air inlet sealing step surface. When the air inlet sealing structure is the air inlet sealing protruding rib or the air inlet sealing step surface and the upper air inlet baffle plate 81 is overlapped with the air inlet sealing protruding rib or the air inlet sealing step surface, not only may a sealing effect be achieved, but also limiting and retaining effects on the upper air inlet baffle plate 81 may be achieved, thereby effectively avoiding excessive movement of the upper air inlet baffle plate 81 and further improving the movement reliability of the upper air inlet baffle plate 81.

In another specific embodiment, the first side of the upper air inlet baffle plate 81 is pivotally connected with the front panel 6, and the second side of the upper air inlet baffle plate 81 is overturned towards a side of the air duct cover plate 2. The front panel 6 belongs to a movement component, so that mounting the upper air inlet baffle plate 81 on the front panel 6 may increase an overall weight and movement burden of the front panel 6.

Figure 21:
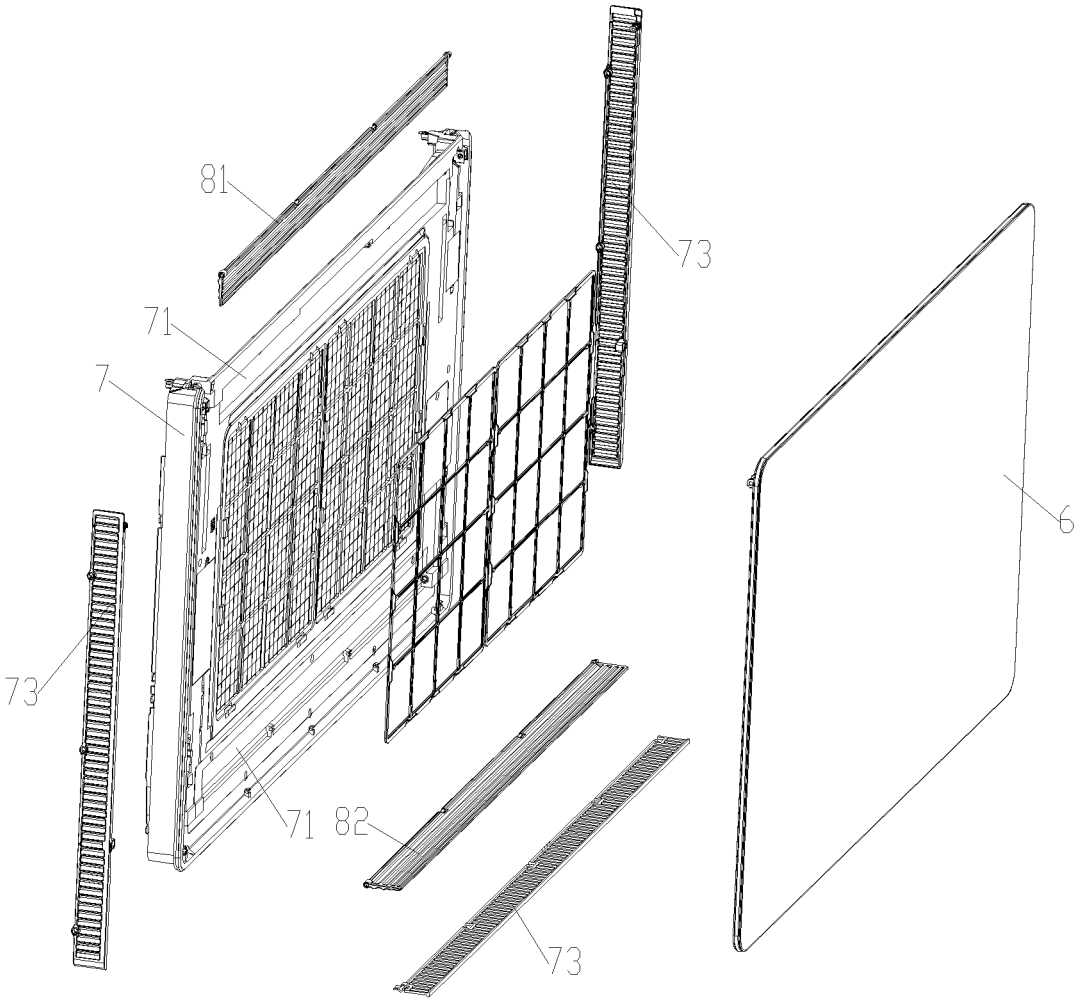
FIG. 21 is an exploded structure diagram of a panel body and a front panel of an air conditioner according to an embodiment of the invention.

As shown in FIG. 21, for improving the accommodation reliability of the upper air inlet baffle plate 81, in the invention, a baffle plate accommodating groove 71 is formed in a surface of the side, facing the front panel 6, of the air passage cover plate 2, and the upper air inlet baffle plate 81 may be accommodated in the baffle plate accommodating groove 71. With formation of the baffle plate accommodating groove 71 for accommodating the upper air inlet baffle plate 81 in the air passage cover plate 2, the upper air inlet 61 may be completely opened and uncovered when the upper air inlet baffle plate 81 is folded to avoid the upper air inlet 61, thereby ensuring the inlet air volume of the air conditioner and ensuring the energy efficiency of the air conditioner.

Similarly, the baffle plate accommodating groove 71 may further be used for accommodating the lower air inlet baffle plate 82.

In a preferred implementation mode shown in FIG. 1 and FIG. 25, the air conditioner further comprises the bottom shell 1, the air passage cover plate 2, the panel body 7 and the front panel 6, the upper air inlet 61 and the lower air inlet 62 are formed between the panel body 7 and the front panel 6, and the upper air inlet baffle plate 81 and the lower air inlet baffle plate 82 are provided between the front panel 6 and the panel body 7 in the overturning manner. At this moment, the panel body 7 is clamped between the air passage cover plate 2 and the front panel 6, so that the air inlets should be formed between the panel body 7 and the front panel 6 when the front panel 6 moves.

Preferably, positions of the front panel 6 and the panel body 7 are adjustably connected. The positions of the front panel 6 and the panel body 7 are adjustably connected, so that a distance between the front panel and the panel body 7 may be changed to regulate the sizes of the air inlets to endow the characteristic of adjustability of the inlet air volume within the unit time to the air conditioner and further optimize heat exchange reliability of the air conditioner.

At this moment, the first side of the upper air inlet baffle plate 81 is pivotally connected with the front panel 6 and/or the panel body 7, and the second side of the upper air inlet baffle plate 81 is a free side. The upper air inlet baffle plate 81 is pivotally connected with the front panel 6 and/or the panel body 7, so that the movement reliability and accommodation reliability of the upper air inlet baffle plate 81 are improved. When the upper air inlet baffle plate 81 is in the folded state of not stopping air, the upper air inlet baffle plate 81 is closely attached to the panel body 7 or the front panel 6 to avoid the upper air inlet 61, thereby ensuring the air inlet reliability of the air conditioner.

Similarly, the connecting relationship between the lower air inlet baffle plate 82 and the front panel 6 and/or the panel body 7 is similar to the connecting relationship between the upper air inlet baffle plate 81 and the front panel 6 and/or the panel body 7, and will not be elaborated herein.

In the preferred implementation mode, the first side of the upper air inlet baffle plate 81 is pivotally connected with the panel body 7, an air inlet sealing structure is provided on a surface of the side, facing the panel body 7, of the front panel 6, and the second side of the upper air inlet baffle plate 81 is in sealing fit with the air inlet sealing structure. With arrangement of the air inlet sealing structure in sealing fit with the second side of the upper air inlet baffle plate 81, the return air prevention reliability of the upper air inlet baffle plate 81 is ensured, thereby solving the problem of backflow caused by air leakage. Of course, such an air inlet sealing structure is also provided at the position corresponding to the lower air inlet baffle plate 82 on the front panel 6.

Similarly, the air inlet sealing structure comprises an air inlet sealing protruding rib or an air inlet sealing step surface.

Or, the first side of the upper air inlet baffle plate 81 is pivotally connected with the front panel 6, and the second side of the upper air inlet baffle plate 81 is overturned towards a side of the panel body 7.

As shown in FIG. 24, for improving the accommodation reliability of the upper air inlet baffle plate 81, in the invention, a baffle plate accommodating groove 71 is formed in a surface of the side, facing the front panel 6, of the panel body 7, and the upper air inlet baffle plate 81 is accommodated in the baffle plate accommodating groove 71. With formation of the baffle plate accommodating groove 71 for accommodating the upper air inlet baffle plate 81 in the panel body 7, the upper air inlet 61 is completely opened and uncovered when the upper air inlet baffle plate 81 is folded to avoid the upper air inlet 61, thereby ensuring the inlet air volume of the air conditioner and ensuring the energy efficiency of the air conditioner. Similarly, the baffle plate accommodating groove 71 further is used for accommodating the lower air inlet baffle plate 82.

The air conditioner in the invention further comprises air inlet grills 73 provided corresponding to the lateral air inlet 63 and the lower air inlet 62 respectively, and the air inlet grills 73 are connected with the driving mechanism 76 and/or the front panel 6 to synchronously move along with the front panel 6. With arrangement of the air inlet grills 73, the problem of accidental injuries caused by accidentally touching the air inlets by hands is effectively solved, thereby improving service safety of the air conditioner.

As shown in FIG. 22, the air inlet grills 73 are in a louver form. When the whole air conditioner is mounted on a wall, it is impossible to see inner structural details of the air conditioner through the air inlet grills 73 from the angle of the user, and indoor air enters the air conditioner through the air inlet grills 73 for heat exchange and air conditioning.

For improving accommodation reliability of the air inlet grills 73, grill accommodating grooves are formed in the panel body 7, and the air inlet grills 73 are accommodated in the grill accommodating grooves respectively.

The specific structures and connecting relationships of the air outlet baffle plates 9 will be described below in detail.

Figure 18:
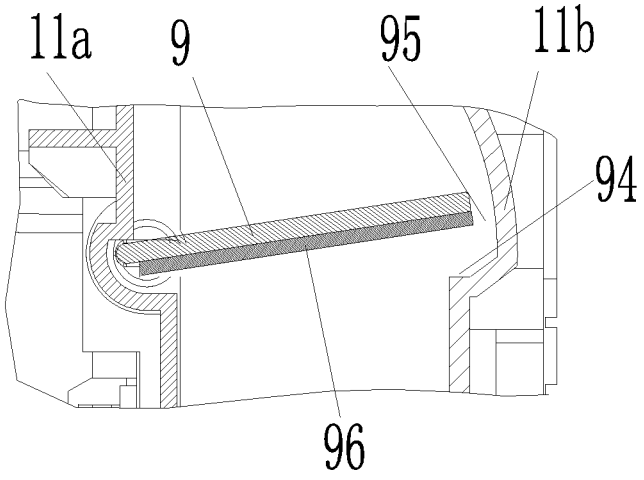
FIG. 18 is a partial enlarged structure diagram of FIG. 16.

As shown in FIG. 16 and FIG. 18, the air outlet baffle plate 9 is driven by a stepper motor 93. The stepper motor 93 is a controllable motor favorable for solving the problem of incomplete rotation.

A first sidewall 11*a* of the air passage 11 is formed by the air passage cover plate 2, and a second sidewall 11*b* of the air passage 11 is formed by the bottom shell 1.

Preferably, the air outlet baffle plate 9 is attached onto the first sidewall 11*a* of the air passage 11 at the first position. This is favorable for avoiding ventilation of the air passage 11 being stopped.

Preferably, the air passage 11 is provided with the first sidewalls 11*a* and second sidewalls 11*b* which are provided opposite to each other, a first end of the air outlet baffle plate 9 is pivotally connected to the first sidewall 11*a* of the air passage 11, and a second end of the air outlet baffle plate 9 is matched with the second sidewall 11*b* of the air passage 11.

A rotating groove for providing a rotating space for the first end of the air outlet baffle plate 9 is formed in the first sidewall 11*a* of the air passage 11. At the second position, the first end of the air outlet baffle plate 9 is in sealing fit with a groove wall of the rotating groove, and the second end of the air outlet baffle plate 9 is matched with the second sidewall 11*b* of the air passage 11 to seal the corresponding air outlet.

Preferably, a first avoiding groove for accommodating the air outlet baffle plate is formed in the first sidewalls 11*a* of the air passage 11. At the first position, the air outlet baffle plate 9 is positioned in the first avoiding groove, and is attached to the first sidewall 11*a* so as to avoid ventilation of the air outlet being stopped.

Preferably, a retaining step surface 94 is provided on the second sidewall 11*b* of the air passage 11, and the second end of the air outlet baffle plate 9 is matched with the retaining step surface 94. At the second position, the second end of the air outlet baffle plate 9 is pressed against the retaining step surface 94, so that contact areas are enlarged, and the sealing effect is favorably improved.

Preferably, the retaining step surface 94 is back on to the corresponding air outlet. The retaining step surface 94 faces a side where the air is blown. When the corresponding air outlet is opened or sealed, the blown air drives the air outlet baffle plate 9 to rotate towards the retaining step surface 94, and pressure of the blown air in the air passage 11 promotes the second end of the air outlet baffle plate 9 to squeeze the retaining step surface 94, which is favorable for further improving the sealing effect.

Preferably, a second avoiding groove 95 for avoiding the second end of the air outlet baffle plate is formed in the second sidewall 11*b* of the air passage 11, and a groove wall, back on to the air outlet, of the second avoiding groove 95 forms the retaining step surface 94.

The second avoiding groove 95 is an arc shape adapted to a movement track of the second end of the air outlet baffle plate 9, and forms the retaining step surface 94 at an endpoint of the movement track of the second end of the air outlet baffle plate 9.

Preferably, a sealing gasket 96 is provided between the air outlet baffle plate 9 and the retaining step surface 94. Furthermore, the sealing effect is improved, and occurrence of an air leakage phenomenon is prevented. The sealing gasket 96 is adopt an elastic material such as sponge and rubber.

One of the two air outlets of the air passage 11 is formed in an upper part of the air conditioner, and the other is formed in a lower part of the air conditioner. In the cooling mode, if the user dislikes the cold air to be directly blown downwards, the upward air outlet is adopted; and in the heating mode, if the user likes the hot air to be directly blown, the downward air outlet is adopted. The user regulates the air to be blown through the specific air outlets according to own requirement.

The air passage 11 is provided with the first sidewall 11*a* and the second sidewall 11*b* which are provided opposite to each other, and the first sidewall 11*a* of the air passage 11 is provided with a first inclined air guide surface close to the corresponding air outlet and/or the second sidewall 11*b* is provided with a second inclined air guide surface close to the corresponding air outlet.

Preferably, the first sidewall 11*a* is provided with the first inclined air guide surface, and the first inclined air guide surface is inclined towards a direction deviated from a wall; and the second sidewall 11*b* is provided with the second inclined air guide surface, and the second inclined air guide surface is inclined in the direction deviated from the wall. The first sidewall and the second sidewall are arranged in a manner that air outlet directions are inclined towards the direction deviated from the wall.

Preferably, the air conditioner comprises the two air passage 11 which are formed abreast, which is favorable for increasing an air volume involved in heat exchange and improving the heat exchange efficiency.

According to another aspect of the invention, a control method for the air outlet baffle plate of the abovementioned air conditioner is provided, which comprises that: the air outlet baffle plate is driven by the stepper motor 93 to rotate.

Preferably, the step that the air outlet baffle plate is driven by the stepper motor 93 to rotate comprises that: numbers of pulses output to the stepper motor 93 is larger than calculated numbers of pulses required by the stepper motor.

Rotation amount of the stepper motor is directly proportional to numbers of received pulses, and the calculated numbers of the pulses required by the stepper motor are numbers of required pulses calculated according to preset required rotation amounts of the stepper motor 93 on the basis of the directly proportional relationship. However, there may usually exist the phenomenon that a practical rotation amount is mismatched with a number of received pulses for a stepper motor. For avoiding the phenomenon of incomplete rotation of the air outlet baffle plate, the numbers of the pulses output to the stepper motor should be larger than the calculated numbers of the pulses required by the stepper motor to solve the problem.

In the embodiment, the air conditioner further comprises an air leakage preventing structure. Structures and functions of the air leakage preventing structures will be described below in detail.

As shown in FIG. 1 and FIG. 16, the air passage 11 is formed in the bottom shell 1, the air passage cover plate 2 is matched with the bottom shell 1, and is provided on the air passage 11 in the covering manner, and the air passage cover plate 2 is provided with a flow guide opening 21 communicated with the air passage 11; the centrifugal impeller 31 is provided in the air passage 11, and correspond to the flow guide opening 21, and a fit clearance is formed between the centrifugal impeller 31 and the air passage cover plate 2; and the air leakage preventing structure is provided at the fit clearance to reduce leaking air volumes at the fit clearance.

With arrangement of the air leakage preventing structure at the fit clearance, an effective stopping effect is achieved at the fit clearance, overflow of inlet air from the fit clearance is avoided or reduced, the air inlet reliability is ensured, and it is ensured that there is a sufficient inlet air volume blown into the centrifugal impeller 31, so that the energy efficiency and heat exchange effect of the air conditioner are improved, and moreover, vibration and noise caused by turbulence are effectively reduced. Formation of condensations is radically avoided, so that safety threats of the condensations to electric components are eliminated, potential safety hazards are eliminated, and the running reliability of the air conditioner is further ensured.

As shown in FIG. 16, the air leakage preventing structure in the invention further comprises an annular air stopping protruding edge 312, the air stopping protruding edge 312 is provided on the centrifugal impeller 31, and are provided in a manner of extending towards a side of the air passage cover plate 2, and an internal diameter of the annular air stopping protruding edge 312 is larger than a diameters of the corresponding flow guide opening 21. With arrangement of the air stopping protruding edge 312 extending towards the side of the air passage cover plate 2 on the centrifugal impellers 31, the fit clearance is partially covered, so that a width and leaking air volumes of an air leakage gap are reduced, and an effective inlet air volume and air inlet reliability of the air conditioner are further improved.

In a specific implementation mode shown in FIG. 16, the air stopping protruding edge 312 is positioned on a peripheral edge of an inner side of an upper surface of the flow guide ring of the centrifugal impeller 31. The air stopping protruding edge 312 is provided on the peripheral edge of the inner side of the flow guide ring of the centrifugal impeller 31, so that overflow of the air inlet is prevented at first time, and an air leakage preventing effect is optimized.

Of course, the air stopping protruding edge 312 is also provided at a part between an inner ring and an outer ring of the centrifugal impeller 31, or is directly provided on an outer ring side of the centrifugal impeller 31. In such a manner, although the air leakage preventing effect may still be achieved, part of air volume may swirl in a space between the air stopping protruding edge 312 and an inner ring side of the centrifugal impeller 31, which may easily cause turbulence and worsen the vibration and noise of the air conditioner.

Preferably, the air leakage preventing structure comprises an air leakage preventing groove 24 provided in the air passage cover plate 2, and the air stopping protruding edge 312 is embedded into the air leakage preventing groove 24, and form clearance fit with the air leakage preventing groove 24 (referring to FIG. 16). The air stopping protruding edge 312 is embedded into the air leakage preventing groove 24, so that triple covering is formed in an air leakage direction, an air overflow path is prolonged, and tortuousness of the overflow path is increased. Therefore, the air is unlikely to overflow from the fit clearance, and air leakage preventing reliability between the centrifugal impeller 31 and the air passage cover plate 2 is ensured.

Furthermore, a groove wall surface of the air leakage preventing groove 24 is a cambered surface. The groove wall surface of the air leakage preventing groove 24 is a cambered surface, so that the air may flow along the smooth and cambered air guide surface when overflowing, stress concentration or swirling is avoided, and a vibration and noise of the air conditioner are effectively reduced.

The air leakage preventing structure in the invention comprises an air leakage preventing protruding edge, and the air leakage preventing protruding edge is a flange provided in a manner of extending from the corresponding flow guide opening 21 of the air passage cover plate 2 to a side of the air passage 11. The air flows from the side of the air passage cover plate 2 to the side of the centrifugal impeller 31, so that the air leakage preventing protruding edge may achieve an effect air guide effect to ensure that the air is smoothly poured into the centrifugal impeller 31 under an action of the air leakage preventing protruding edge. The air leakage preventing protruding edge is provided in the manner of extending from the air passage cover plate 2 to the side of the centrifugal impeller 31, so that the fit clearance is partially covered, the width and leaking air volume of the air leakage gap are reduced, and the effective inlet air volume and air inlet reliability of the air conditioner are further improved.

When the air leakage preventing protruding edge is embedded into an inner side of the flow guide opening 21 and further extends into the side of the centrifugal impeller 31, an opening direction of the air leakage gap is changed at this moment. Preferably, the air leakage preventing protruding edge is provided at a peripheral edge of the flow guide opening 21, and is provided in the manner of extending towards the inner ring side of the centrifugal impeller 31 to deviate the opening direction of the air leakage gap from an air inlet direction of the flow guide opening 21. When the opening direction of the air leakage gap is deviated from the air inlet direction of the flow guide opening 21, at this moment, air blown from the air inlet direction is directly blown into the centrifugal impeller 31, and the inlet air is unlikely to change a flowing direction to enter an opening of the air leakage gap, so that the leaking air volume between the centrifugal impeller 31 and the air passage cover plate 2 is effectively reduced, and the energy efficiency and heat exchange effect of the air conditioner are ensured.

For further improving the air leakage preventing effect, the air leakage preventing protruding edge is an annular, and the air leakage preventing protruding edge is provided on an inner ring side of the air stopping protruding edge 312. With arrangement of both the air stopping protruding edge 312 and the air leakage preventing protruding edge, dual air leakage preventing protection is formed, and the leaking air volume is further reduced. Since the air leakage preventing protruding edge also has an air guide function, when the air leakage preventing protruding edge contacts with the inlet air before the air stopping protruding edge 312, the air leakage preventing effect may be optimized, and the air passage cover plate 2 may function to cover and seal the centrifugal impeller 31 to a certain extent.

Of course, the air stopping protruding edge 312 and the air leakage preventing protruding edge may also be sequentially provided at intervals. However, in such an arrangement manner, the air leakage preventing effect of the air conditioner is relatively poor.

In the invention, there are a plurality of flow guide openings 21, a plurality of air leakage preventing structures and a plurality of centrifugal impellers 31, and the centrifugal impellers 31, the flow guide openings 21 and the air leakage preventing structures are provided in a one-to-one corresponding manner. The air leakage preventing structure is correspondingly provided at each of the flow guide openings 21, so that overall air leakage preventing performance of the air conditioner is ensured. In a preferred implementation mode shown in FIG. 10, there are two flow guide openings 21, and the air leakage preventing structures are correspondingly provided at the two flow guide openings 21 respectively.

Preferably, there are a plurality of air passages 11, the air passages 11 are independently provided, and the air passages 11 and the centrifugal impellers 31 are provided in the one-to-one corresponding manner. The air passages 11 are independently provided, so that turbulence during running of the multiple centrifugal impellers 31 is effectively avoided, and air outlet reliability of the air conditioner is improved.

For further improving the energy efficiency and control diversity of the air conditioner, there are a plurality of evaporators in the invention, and the evaporators and the flow guide openings 21 are provided in the one-to-one corresponding manner. With use of the multiple evaporators, mass of each evaporator is reduced, so that convenience for mounting of the air conditioner is improved. When a single evaporator fails, only the single evaporator is required to be maintained and replaced, so that maintenance complexity and maintenance cost are reduced, and service life of the air conditioner is prolonged. In addition, a single evaporator or part of evaporators may also be controlled to regulate running power of the air conditioner to meet different using requirements.

Preferably, the evaporator is a round and a shape of the evaporator is adapted to a shape of corresponding flow guide opening 21. The shape of the evaporator is provided to be adapted to the shape of the corresponding flow guide opening 21, so that each part on the evaporator has the characteristic of high consistency in running performance, and heat exchange efficiency of each part of the evaporator is evenly. In addition, the round evaporator may also effectively improve the heat exchange efficiency, increase an energy efficiency level of the air conditioner and reduce power consumption, and may further save materials, reduce cost wastes and reduce the occupied space.

It is important to note that, for ensuring uniformity of a coolant flow rate, in-tube pressure drop and temperature distribution of each part in the evaporator, a tube diameter and a segment pitch are required to be designed by combining coolant flow rates of different flow paths, the in-tube pressure drops and an air velocity distribution of a surface of the evaporator. By adopting combined design of different tube diameters and different segment pitches, high-efficiency heat exchange is implemented. In addition, for facilitating machining and manufacturing, U tubes of the evaporator are on the same side, and procedures of welding and the like are performed on a pipeline on the other side.

In the embodiment, the air passage 11 comprises a first air passage 111 and second air passage 112 extending from an upper side to a lower side. A dual-air-passage arrangement form with the first air passage 111 and the second air passage 112 and a function will be introduced below in detail.

Figure 4:
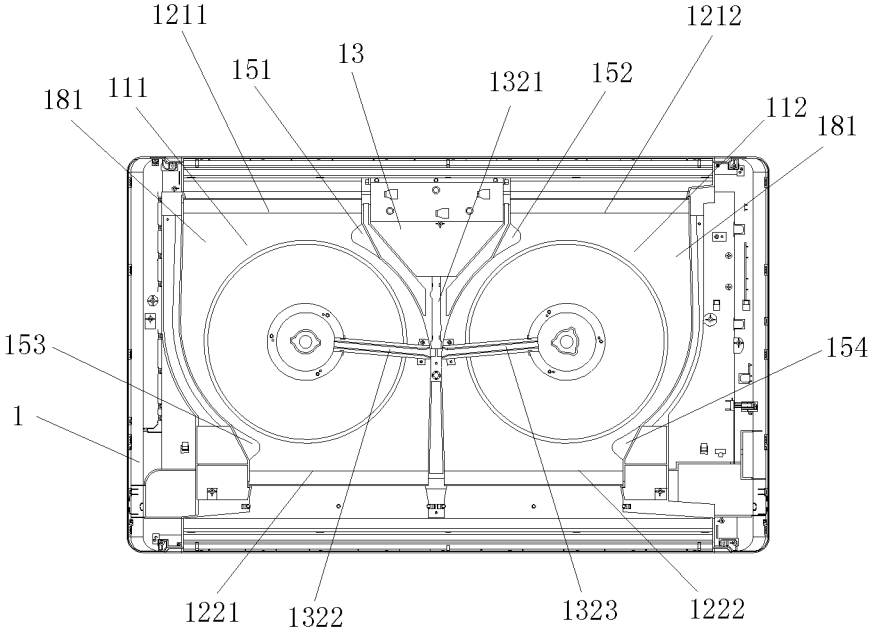
FIG. 4 is a front structure diagram of a bottom shell of an air conditioner according to an embodiment of the invention.

As shown in FIG. 4 and FIG. 24, the first air passage 111 and the second air passage 112 are symmetrically provided, wherein the first air passage 111 is provided with a first upper air outlet 1211 corresponding to the upper side and a first lower air outlet 1221 corresponding to the lower side, and the second air passage 112 is provided with a second upper air outlet 1212 corresponding to the lower side and a second lower air outlet 1222 corresponding to the lower side, wherein the first upper air outlet 1211 and the second upper air outlet 1212 form the upper air outlet 121, and the first lower air outlet 1221 and the second lower air outlet 1222 form the lower air outlet 122.

As shown in FIG. 4, a first upper volute tongue 151 is provided at the first upper air outlet 1211, a first lower volute tongue 153 is provided at the first lower air outlet 1221, a second upper volute tongue 152 is provided at the second upper air outlet 1212, and a second lower volute tongue 154 is provided at the second lower air outlet 1222. Specifically, the first lower volute tongue 153 and the second lower volute tongue 154 protrude towards directions of getting close to each other respectively, and the first upper volute tongue 151 and the second upper volute tongue 152 protrude towards directions of getting deviated from each other respectively. The air conditioner of the embodiment further comprises a first centrifugal fan 3*a* and a second centrifugal fan 3*b*, wherein the first centrifugal fan 3*a* is provided in the first air passage 111, and the second centrifugal fan 3*b* is provided in the second air passage 112.

In the invention, the first lower volute tongue 153 and the second lower volute tongue 154 protrude towards the directions of getting close to each other respectively, and the first upper volute tongue 151 and the second upper volute tongue 152 protrude towards the directions of getting deviated. The arrangement directions of the first lower volute tongue 153 and the second lower volute tongue 154 determine convergence of an air outlet direction of the first air passage 111 at the first lower air outlet 1221 and an air outlet direction of the second air passage 112 at the second lower air outlet 1222. In such a manner, when the air conditioner is in the heating state, hot air flows out of the first lower air outlet 1221 and the second lower air outlet 1222 of the air conditioner, and the hot air flowing from the first air passage 111 is converged with the hot air flowing from the second air passage 112 to further improve a heating effect and improve heating performance of the air conditioner. In addition, the hot air is relatively low in density, the hot air slowly rises after being blown from the first lower air outlet 1221 and the second lower air outlet 1222 of the air conditioner, thereby forming indoor overall thermal cycles and achieving high temperature comfort. Therefore, the technical solution of the embodiment may solve the problem of low heating speed of the air conditioner in the prior art.

In addition, during cooling of the air conditioner, cold air is blown from the first upper air outlet 1211 and the second upper air outlet 1212. Blowing the cold air upwards may avoid direct blowing to a human body. Moreover, a gas at a low temperature is high in density, so that the cold air may gradually lower to increase a cooling speed. Therefore, the air conditioner of the embodiment has the characteristics of good cooling effect and high comfort for the human body.

The air conditioner of the embodiment is provided with four air outlets, i.e. the first upper air outlet 1211, the first lower air outlet 1221, the second upper air outlet 1212 and the second lower air outlet 1222. As a preferred implementation mode, an air outlet baffle plate is provided at each air outlet. Therefore, air blowing of the air outlets is controlled according to the requirement of the user. Specifically, during cooling or heating, the four air outlets is opened at the same time to achieve a maximum outlet air volume. Of course, in consideration of comfort, the first upper air outlet 1211 and the second upper air outlet 1212 are sealed by virtue of the air outlet baffle plates during heating to blow the hot air only from the first lower air outlet 1221 and the second lower air outlet 1222, and the first lower air outlet 1221 and the second lower air outlet 1222 are sealed by virtue of the air outlet baffle plates during cooling to blow the hot air only from the first upper air outlet 1211 and the second upper air outlet 1212.

As shown in FIG. 4, in the technical solution of the embodiment, the first upper volute tongue 151 and the second upper volute tongue 152 are provided on inner walls respectively, which are close to each other, on the first upper air outlet 1211 and the second upper air outlet 1212, and the first lower volute tongue 153 and the second lower volute tongue 154 are respectively provided on inner walls, which are far away from each other, on the first lower air outlet 1221 and the second lower air outlet 1222. Meanwhile, a distance between the first upper volute tongue 151 and the second upper volute tongue 152 is smaller than a distance between the first lower volute tongue 153 and the second lower volute tongue 154. Such a structure makes sizes of the first upper air outlet 1211, the second upper air outlet 1212, the first lower air outlet 1221 and the second lower air outlet 1222 relatively larger, and may further effectively ensure the outlet air volume.

Figure 6:
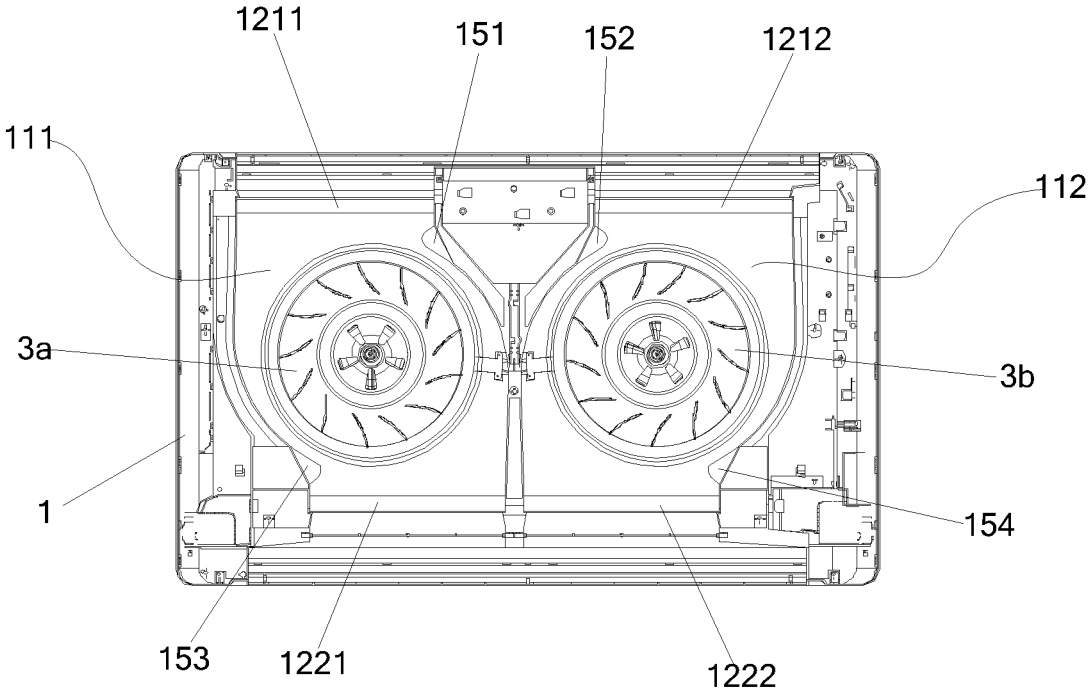
FIG. 6 is a structure diagram of a bottom shell of an air conditioner and centrifugal fans mounted on the bottom shell according to an embodiment of the invention.

As shown in FIG. 6, in the technical solution of the embodiment, rotating directions of blades of the first centrifugal fan 3*a* are opposite to rotating directions of blades of the second centrifugal fan 3*b*. Specifically, when the first centrifugal fan 3*a* and second centrifugal fan 3*b* of the air conditioner work, the first centrifugal fan 3*a* and the second centrifugal fan 3*b* may drive airflows and generate certain impact forces on the air conditioner respectively. Since the rotating directions of the blades of the first centrifugal fan 3*a* are opposite to the rotating directions of the blades of the second centrifugal fan 3*b*, the first centrifugal fan 3*a* may make the impact force, generated when the first centrifugal fan 3*a* works, on the air conditioner and the second centrifugal fan 3*b* may make the impact force, generated when the second centrifugal fan 3*b* works, on the air conditioner opposite. Therefore, the air conditioner is evenly in stress and stable in running, and meanwhile, the noise may be effectively reduced.

Preferably, when the air conditioner works, a rotating direction of the first centrifugal fan 3*a* and a rotating direction of the second centrifugal fan 3*b* are opposite, so that the impact forces, generated by the first centrifugal fan 3*a* and the second centrifugal fan 3*b*, on the air conditioner are further counteracted.

As shown in FIG. 7, in the technical solution of the embodiment, the air conditioner further comprises a first upper swing mechanism 161 and a second upper swing mechanism 162, and the first upper swing mechanism 161 and the second upper swing mechanism 162 form an upper swing mechanism, wherein the first upper swing mechanism 161 is provided at the first upper air outlet 1211, and the second upper swing mechanism 162 is provided at the second upper air outlet 1212. The first upper swing mechanism 161 and the second upper swing mechanism 162 are used for changing the air outlet directions, so that the air outlet directions of the first upper air outlet 1211 and the second upper air outlet 1212 are more flexible.

Specifically, directions of the first upper swing mechanism 161 and the second upper swing mechanism 162 are controlled to selectively endow the following working states to the first upper swing mechanism 161 and the second upper swing mechanism 162: the first upper swing mechanism 161 and the second upper swing mechanism 162 guide towards the same side; the first upper swing mechanism 161 and the second upper swing mechanism 162 convergently guide towards inner sides; and the first upper swing mechanism 161 and the second upper swing mechanism 162 diffusely guide towards outer sides.

When the air conditioner works, any one of the above-mentioned working states may be selected. Therefore, the air outlet directions are more flexible, and temperature regulation requirements of different environments are met.

Preferably, the first upper swing mechanism 161 and the second upper swing mechanism 162 are controlled respectively, so that it is easier to implement the three working states.

As shown in FIG. 7, in the technical solution of the embodiment, the air conditioner further comprises a first lower swing mechanism 163 and a second lower swing mechanism 164, and the first lower swing mechanism 163 and the second lower swing mechanism 164 form a lower swing mechanism, wherein the first lower swing mechanism 163 is provided at the first lower air outlet 1221, and the second lower swing mechanism 164 is provided at the second lower air outlet 1222. The first lower swing mechanism 163 and the second lower swing mechanism 164 are used for changing air outlet directions, so that the air outlet directions of the first lower air outlet 1221 and the second lower air outlet 1222 are more flexible.

Specifically, directions of the first lower swing mechanism 163 and the second lower swing mechanism 164 are controlled to selectively endow the following working states to the first lower swing mechanism 163 and the second lower swing mechanism 164: the first lower swing mechanism 163 and the second lower swing mechanism 164 guide towards the same side; the first lower swing mechanism 163 and the second lower swing mechanism 164 convergently guide towards inner sides; and the first lower swing mechanism 163 and the second lower swing mechanism 164 diffusely guide towards outer sides.

When the air conditioner works, any one of the above-mentioned working states may be selected. Therefore, the air outlet directions are more flexible, and temperature regulation requirements of different environments are met.

Preferably, the first lower swing mechanism 163 and the second lower swing mechanism 164 are controlled respectively, so that it is easier to implement the three working states.

In the embodiment, the air conditioner further comprises an electric box mounting part 13, and a specific structure and connecting relationship of the electric box mounting part 13 will be introduced below in detail. The electric box mounting part 13 is provided between the first upper volute tongue 151 and the second upper volute tongue 152. An electric box 131 mounted with a circuit board is provided in the electric box mounting part 13, and motor wires of the first centrifugal fan 3*a* and the second centrifugal fan 3*b* are connected with the circuit board, thereby supplying power to motors of the first centrifugal fan 3*a* and the second centrifugal fan 3*b*. Wiring is simple and high in reliability. In addition, in the invention, the electric box mounting part 13 is provided in a cavity formed between the first upper volute tongue 151 and the second upper volute tongue 152, and a service space of the bottom shell 1 is effectively utilized, so that an internal structure of the air conditioner is more compact, and the air conditioner is thinner.

It is important to note that, in the embodiment, an electric component provided in the electric box 131 is a circuit board, and in other implementation modes not shown in the drawings, other electric components capable of supplying power to the motors of the centrifugal fans may also be provided in the electric box 131 according to a specific requirement.

Figure 5:
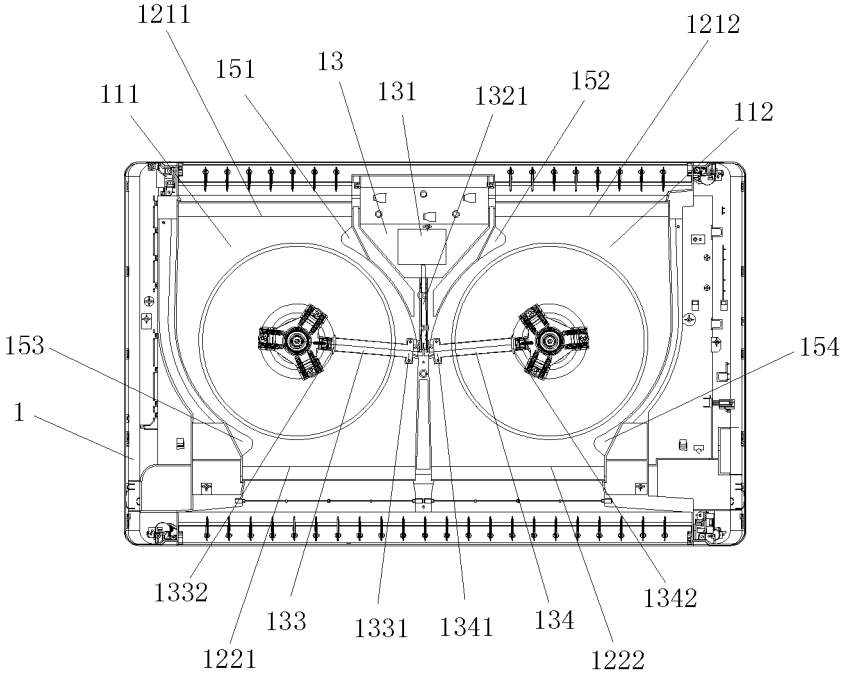
FIG. 5 is a structure diagram of a bottom shell of an air conditioner and a motor mounted on the bottom shell according to an embodiment of the invention.

As shown in FIG. 5 and FIG. 10, in the air conditioner of the embodiment, the air conditioner further comprises the air passage cover plate 2 connected with the bottom shell 1, the first centrifugal fan 3*a* and the second centrifugal fan 3*b* are provided between the bottom shell 1 and the air passage cover plate 2, and the air passage cover plate 2 is provided with a first flow guide opening 211 corresponding to the first centrifugal fan 3*a* and a second flow guide opening 212 corresponding to the second centrifugal fan 3*b*. The first flow guide opening 211 and second flow guide opening 212 in the air passage cover plate 2 may function to guide airflows passing through the first centrifugal fan 3*a* and passing through the second centrifugal fan 3*b* respectively. In addition, the air passage cover plate 2 separates the bottom shell 1 from the other parts (the evaporator in the embodiment) of the air conditioner, so that mounting stability of the first centrifugal fan 3*a* and the second centrifugal fan 3*b* is enhanced.

As shown in FIG. 1, FIG. 5 and FIG. 10, in the air conditioner of the embodiment, a first wiring passage 22 is provided in the air passage cover plate 2, the first wiring passage 22 is provided in a side, far away from the bottom shell 1, of the air passage cover plate 2, and the first wiring passage 22 is communicated with an inner cavity of the electric box mounting part 13. In the embodiment, a driving box 23 is provided on a right side edge of the air passage cover plate 2, and an electric component such as a driving power supply is provided in the driving box 23. An electric wire extending from the driving power supply may extends into the inner cavity of the electric box mounting part 13 through the first wiring passage 22, and is connected and conducted with the circuit board in the electric box 131, thereby supplying the power to the circuit board and further driving the first centrifugal fan 3*a* and the second centrifugal fan 3*b* to work. In addition, the first wiring passage 22 may make a line arrangement more regular, thereby effectively preventing interference between the electric wire and the other parts and ensuring electric safety. It is important to note that the driving box 23 is provided, not limited to, on the right side edge of the air passage cover plate 2. In the other implementation modes which are not shown in the drawings, the driving box 23 may also be provided at another position of the air passage cover plate 2, and for example, is provided on a left side edge of the air passage cover plate 2. Under such a condition, the first wiring passage 22 may also be correspondingly formed in a left side of the air passage cover plate 2.

Figure 11:
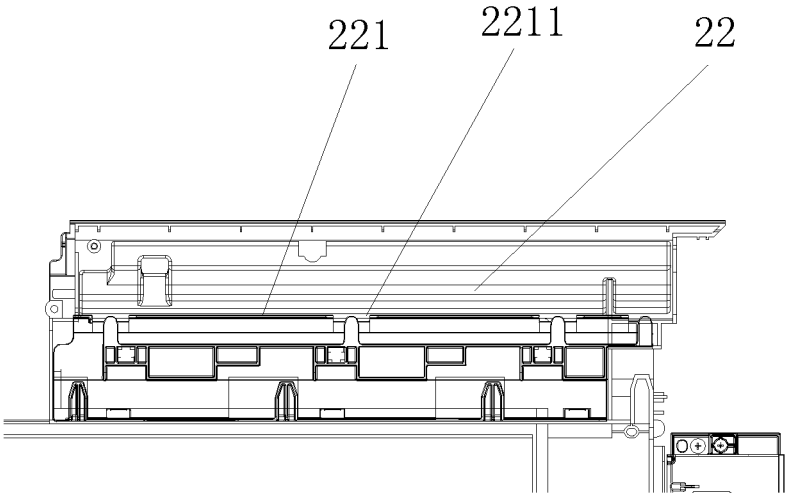
FIG. 11 is a partial enlarged structure diagram of FIG. 10.

As shown in FIG. 10 and FIG. 11, in the air conditioner of the embodiment, the first wiring passage 22 is a first wiring trough. The first wiring trough is simple in structure and easy to machine and manufacture. Of course, the first wiring passage 22 is not limited to the wiring trough, and in the other implementation modes not shown in the drawings, may also be another wiring structure, and for example, may be a wiring hole.

As shown in FIG. 10 and FIG. 11, in the air conditioner of the embodiment, the first wiring trough comprises a high-voltage electric wire slot and a low-voltage electric wire slot, and a separation plate 221 for separation is provided between the high-voltage electric wire slot and the low-voltage electric wire slot. Such a structure may separate a high-voltage electric wire from a low-voltage electric wire and prevent electromagnetic interference between the high-voltage electric wire and the low-voltage electric wire.

As shown in FIG. 10 and FIG. 11, in the air conditioner of the embodiment, a wiring nick 2211 is provided in the separation plate 221. Such a structure makes it more convenient to arrange the electric wires, and is favorable for improving wiring efficiency.

It is important to note that, in the embodiment, the first wiring trough is a split structure detachably provided on the air passage cover plate 2, and wiring troughs with different lengths or different shape structures may be selected according to specific wiring requirements. Of course, the first wiring trough is not limited to the split structure, and in the other implementation modes not shown in the drawings, the first wiring trough and the air passage cover plate 2 may also be arranged to be one whole structure.

As shown in FIG. 10, in the air conditioner of the embodiment, an avoiding nick 222 is formed in a position, corresponding to the electric box mounting part 13, on the air passage cover plate 2. Such a structure may prevent interference between the air passage cover plate 2 and the bottom shell 1 during mounting.

As shown in FIG. 4 and FIG. 5, in the air conditioner of the embodiment, an air passage wall positioned between the first centrifugal fan 3*a* and the second centrifugal fan 3*b* is provided on the bottom shell 1, a second wiring passage 1321 is formed in the air passage wall, a third wiring passage 1322 is correspondingly formed in the bottom shell 1 between the air passage wall and the first centrifugal fan 3*a*, a fourth wiring passage 1323 is correspondingly formed in the bottom shell 1 between the air passage wall and the second centrifugal fan 3*b*, and the second wiring passage 1321 is communicated with the third wiring passage 1322 and the fourth wiring passage 1323 respectively, wherein the second wiring passage 1321 is communicated with the inner cavity of the electric box mounting part 13.

When the air conditioner is assembled, the motor wire of the first centrifugal fan 3*a* extends to the inner cavity of the electric box mounting part 13 through the third wiring passage 1322 and the second wiring passage 1321, and is connected and conducted with the circuit board in the electric box 131, thereby supplying power to the motor of the first centrifugal fan 3*a* and driving the first centrifugal fan 3*a* to rotate. Similarly, the motor wire of the second centrifugal fan 3*b* extends to the inner cavity of the electric box mounting part 13 through the fourth wiring passage 1323 and the second wiring passage 1321, and is connected and conducted with the circuit board in the electric box 131, thereby supplying power to the motor of the second centrifugal fan 3*b* and driving the second centrifugal fan 3*b* to rotate. In addition, the wiring passages may make the line arrangement more irregular, thereby effectively preventing interference between the motor wires and the other parts and ensuring the electric safety.

As shown in FIG. 4 and FIG. 5, in the air conditioner of the embodiment, the second wiring passage 1321 is a second wiring trough, the third wiring passage 1322 is a third wiring trough, and the fourth wiring passage 1323 is a fourth wiring trough. The second wiring trough, the third wiring trough and the fourth wiring trough are simple in structure and easy to machine and manufacture. Of course, the second wiring passage 1321, the third wiring passage 1322 and the fourth wiring passage 1323 are not limited to the wiring troughs, and in the other implementation modes not shown in the drawings, may also be other wiring structures, and for example, may be arranged to be wiring holes.

As shown in FIG. 5, in the air conditioner of the embodiment, a first cover plate 133 is provided on the third wiring trough, and a second cover plate 134 is provided on the fourth wiring trough. Such a structure may prevent the motor wires in the third wiring trough and the fourth wiring trough from being exposed, prevent wire bodies from being scratched when the fan blades of the centrifugal fans rotate and prevent the motor wires from being damaged. In addition, integrity of the air passage may also be ensured, and abnormal noises of the air passage are avoided.

Figure 12:
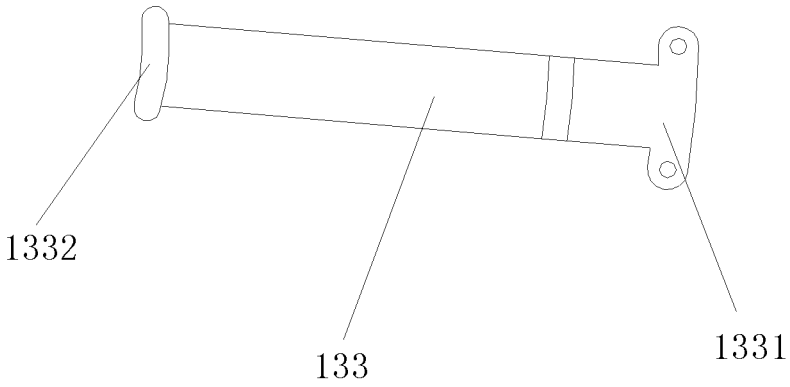
FIG. 12 is a structure diagram of a first cover plate of an air conditioner according to an embodiment of the invention.
Figure 13:
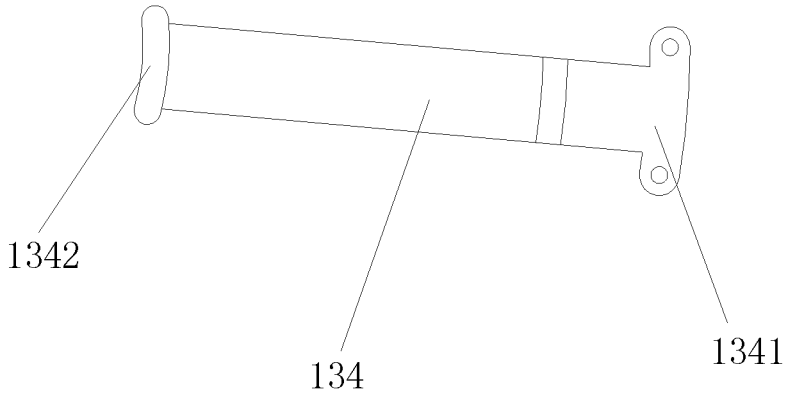
FIG. 13 is a structure diagram of a second cover plate of an air conditioner according to an embodiment of the invention.

As shown in FIG. 5, FIG. 12 and FIG. 13, in the air conditioner of the embodiment, a first connecting part 1331 is provided at a first end of the first cover plate 133, a second connecting part 1332 is provided at a second end of the first cover plate 133, a third connecting part 1341 is provided at a first end of the second cover plate 134, and a fourth connecting part 1342 is provided at a second end of the second cover plate 134. A first electric wire accommodating groove is provided in one side, facing the bottom shell 1, of the first cover plate 133, and a second electric wire accommodating groove is provided in one side, facing the bottom shell 1, of the second cover plate 134.

In the embodiment, positioning columns and studs are provided at the ends, close to the second wiring trough, of both the third wiring trough and the fourth wiring trough, and slots are provided in the ends, far away from the second wiring trough, of both the third wiring trough and the fourth wiring trough. Screw holes are provided in both the first connecting part 1331 and the third connecting part 1341 respectively, the first connecting part 1331 is matched with the positioning column and stud on the third wiring trough, and the third connecting part 1341 is matched with the positioning column and stud on the fourth wiring trough. Both the second connecting part 1332 and the fourth connecting part 1342 are male tabs, the second connecting part 1332 is matched with the slot in the third wiring trough, and the fourth connecting part 1342 is matched with the slot in the fourth wiring trough. Such a structure makes it convenient to assemble and disassemble the first cover plate 133, the second cover plate 134 and the bottom shell 1. Of course, structures of the first cover plate 133 and the second cover plate 134 are not limited, and in the other implementation modes which are not shown in the drawings, the first cover plate 133 and the second cover plate 134 may also be other structures capable of realizing a fixing function.

In the embodiment, the air duct cover plate 2 is provided on the two air passages 11 in the covering manner, specifically the first air passage 111 and the second air passage 112. The two flow guide openings 21 are provided in the air passage cover plate 2, and the two flow guide openings 21 comprises the first flow guide opening 211 corresponding to the first air passage 111 and the second flow guide opening 212 corresponding to the second air passage 112. The first centrifugal fan 3*a* is provided in the first air passage 111, and is provided opposite to the first flow guide opening 211, and the second centrifugal fan 3*b* is provided d in the second air passage 112, and is provided opposite to the second flow guide opening 212. The evaporator 4 is provided on one side, far away from the bottom shell 1, of the air passage cover plate 2, and each flow guide opening 21 is formed opposite to the evaporator 4. In the embodiment, the indoor unit of the air conditioner is provided with a plurality of air passages 11, one centrifugal fan 3 is provided in each air passage 11, and the centrifugal fans 3 are used for heat exchange between the evaporator 4 and the external environment, so that the problem of restriction of a limited air volume to cooling of the air conditioner in the conventional art is solved.

Preferably, the evaporator 4 is superposed with the air passage cover plate 2, and is positioned on one side, back on to the bottom shell 1, of the air passage cover plate 2. The air passages 11 are formed between the air duct cover plate 2 and the bottom shell 1, and extend along the air passage cover plate 2, and the flow guide openings 21 are formed in the air duct cover plate 2, and face the evaporator 4. Such a superposed structure is favorable for reducing the thickness of the indoor unit of the air conditioner and reducing the space occupied by the indoor unit of the air conditioner.

Figure 19:
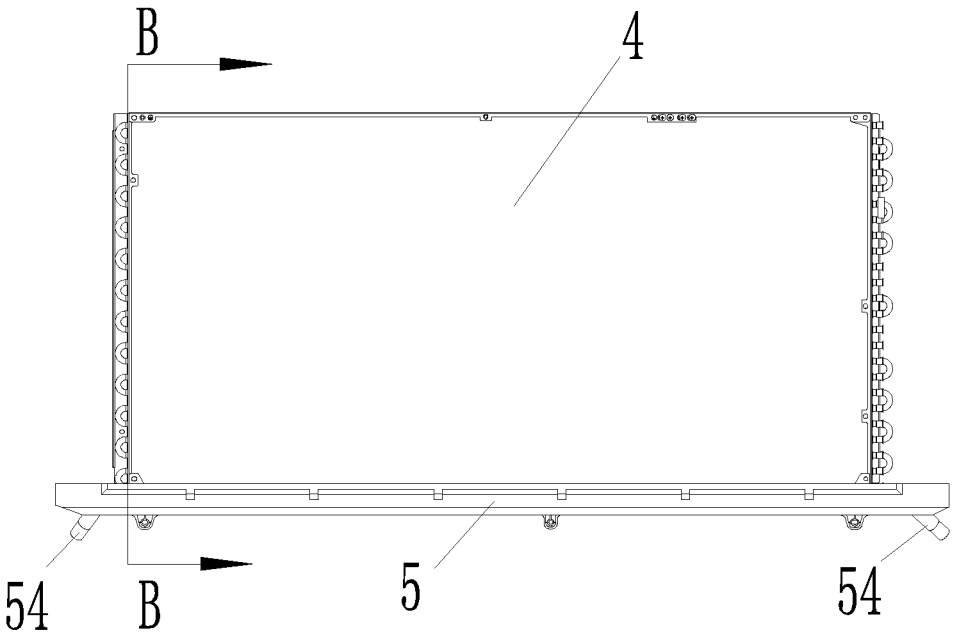
FIG. 19 is a structure diagram of an evaporator and base of an air conditioner according to an embodiment of the invention.
Figure 20:
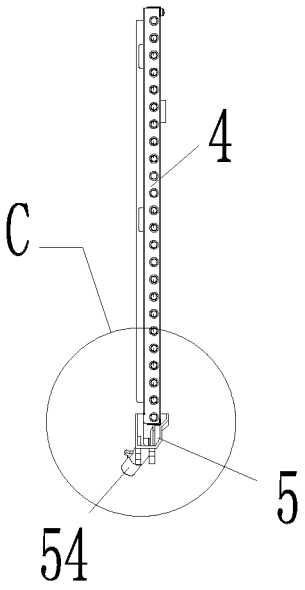
FIG. 20 is a sectional structure diagram of a part B-B in FIG. 19.
Figure 20A:
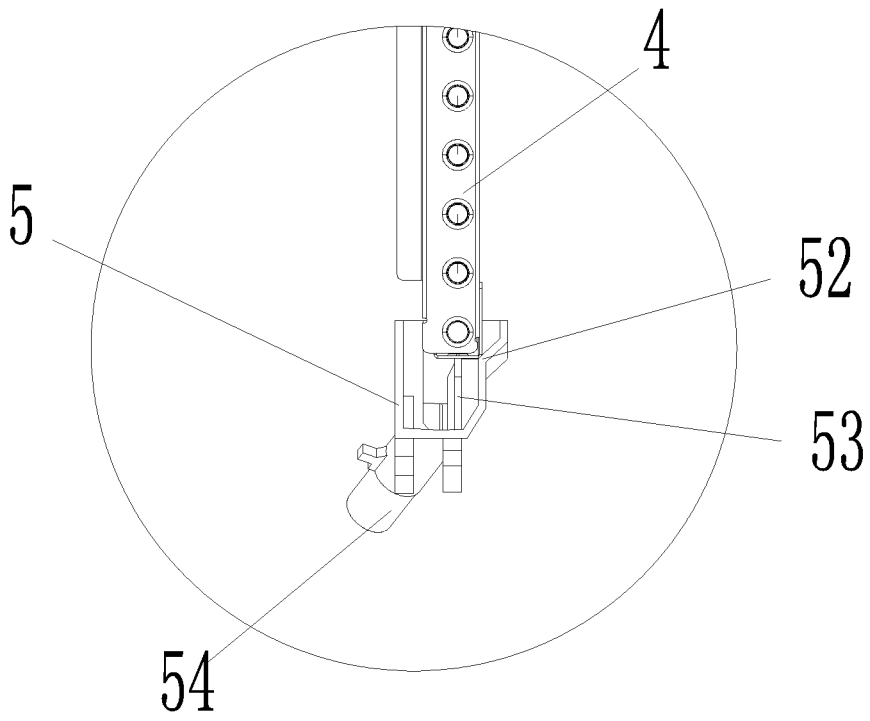
FIG. 20*a* is an enlarged structure diagram of a part C in FIG. 20.

As shown in FIG. 19, FIG. 20 and FIG. 20*a*, the air conditioner of the embodiment further comprises a base 5 for bearing the evaporator 4, a placement groove 51 adapted to the evaporator 4 is provided in the base 5, a bearing platform 52 for the evaporator 4 is provided on a sidewall of the placement groove 51, and a drain trough is provided in the bearing platform 52. A support vertical plate 53 for supporting a heat exchange unit is provided in the placement groove 51, and the support vertical plate 53 comprises a plurality of support plate segments provided at intervals. A space between every two adjacent support plate segments is used for condensed water to flow to avoid an excessively high water level of local condensed water.

As shown in FIG. 19 and FIG. 20, a drain opening is provided in the placement groove 51, and a water diversion pipe 54 for guiding the condensed water out of the indoor unit of the air conditioner is connected with the drain opening. The bearing platform 52 is provided with a plurality of drain troughs for causing the condensed water to smoothly flow to a bottom of the placement groove for unified guide out of the indoor unit of the air conditioner along the evaporator 4. The base 5 is connected with the air passage cover plate 2, and is positioned on one side, back on to the bottom shell 1, of the air passage cover plate 2. The base 5 and the air passage cover plate 2 may be formed integrally and form a whole structure, and may also be split. The evaporator 4 comprises an evaporator body and a bottom frame. The bottom frame is provided below the evaporator body, and a plurality of drain holes are provided in the bottom frame. The condensed water produced on the evaporator body flows into the placement groove of the base 5 provided below the evaporator body through the drain holes, and then is guided out of the indoor unit of the air conditioner through the water diversion pipe 54. Preferably, the drain holes are divided into multiple rows of drain holes, and the drain holes in every two adjacent rows are provided in the staggered manner. Distances between the drain holes in every two adjacent rows in drain directions of the drain holes are shortened, and smooth drain of the condensed water is facilitated.

The air conditioner of the embodiment further comprises a display connected with the electric box, and the display is used for displaying parameters such as a working state of the indoor unit of the air conditioner and the indoor temperature.

Figure 27:
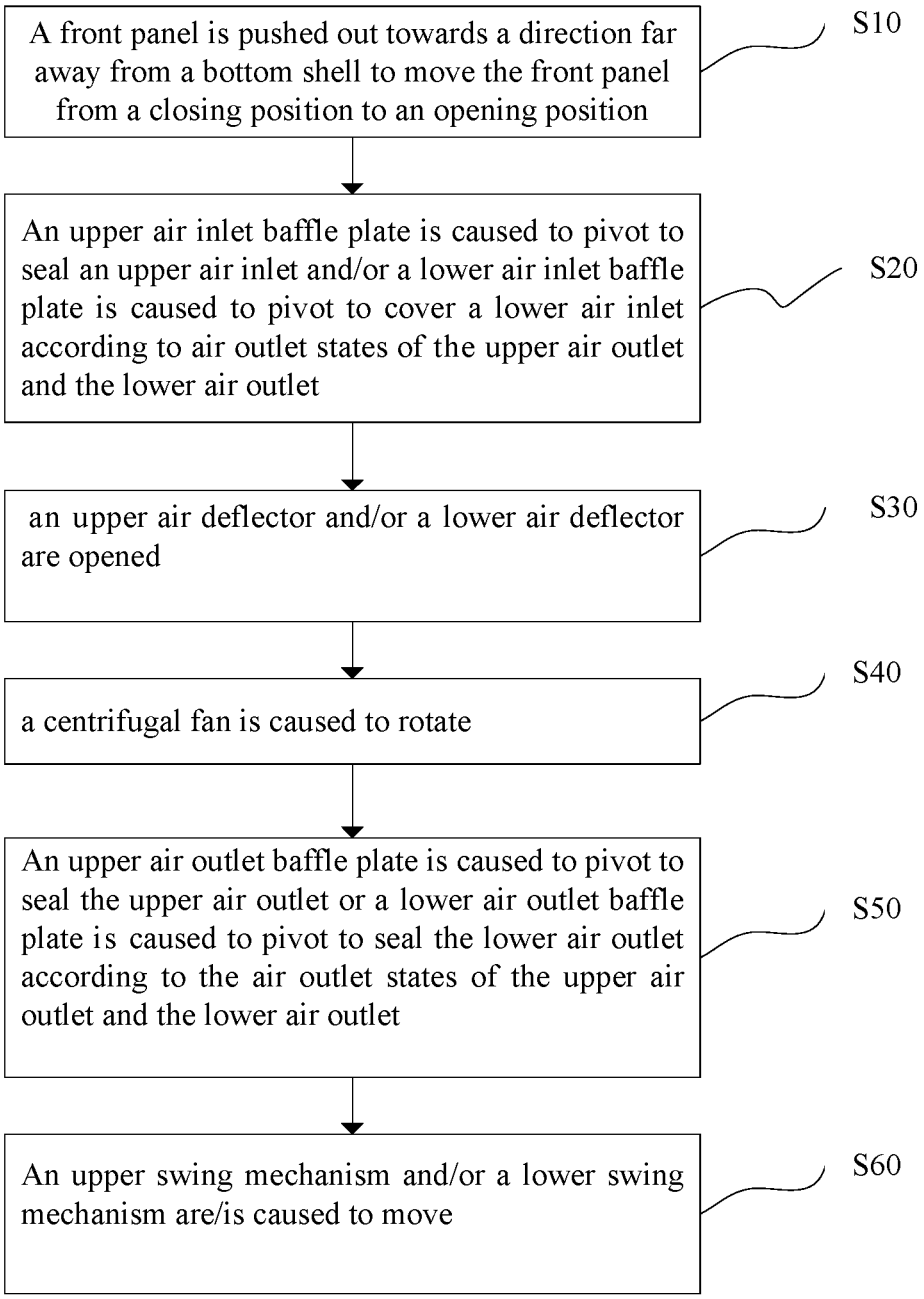
FIG. 27 is a flowchart of turning-on steps of an embodiment of a control method for an air conditioner according to an embodiment of the invention.

The invention further provides a control method for an air conditioner, which is used for controlling the abovementioned air conditioner. As shown in FIG. 27, the control method according to the embodiment comprises a turning-on step and a turning-off step, wherein the turning-on step comprises the following steps.

In Step S10, a front panel 6 is pushed out towards a direction far away from a bottom shell 1 to move the front panel 6 from a closing position to an opening position.

In Step S30, an upper air deflector 171 and/or a lower air deflector 173 are opened.

In Step S40, a centrifugal fan 3 is caused to rotate.

In Step S60, an upper swing mechanism and/or a lower swing mechanism are/is caused to drive the centrifugal fan 3.

In the embodiment, Step S10, Step S30, Step S40 and Step S60 are sequentially executed. Of course, those skilled in the art should know that, as an optional implementation mode, Step S30 and Step S40 may be executed synchronously.

As shown in FIG. 27, in the embodiment, the following step is further comprised between Step S10 and Step S30.

In Step S20, an upper air inlet baffle plate 81 is caused to pivot to seal an upper air inlet 61 and/or a lower air inlet baffle plate 82 is caused to pivot to cover a lower air inlet 62 according to air outlet states of an upper air outlet 121 and a lower air outlet 122.

Of course, those skilled in the art should know that, as an optional implementation mode, Step S20 may also be executed between Step S40 and Step S60.

As shown in FIG. 27, in the embodiment, the following step is further comprised between Step S40 and Step S60.

In Step S50, an upper air outlet baffle plate 91 is caused to pivot to seal the upper air outlet 121 or a lower air outlet baffle plate 92 is caused to pivot to seal the lower air outlet 122 according to the air outlet states of the upper air outlet and the lower air outlet.

It is important to note that Step S20 is required to be executed before Step S50 when Step S20 is executed between Step S40 and Step S60.

With application of the control method of the embodiment, the front panel 6 is caused to move at first, so that other movement parts may be effectively avoided, and a minimum thickness of the air conditioner may be ensured. In addition, the upper air deflector 171 and/or the lower air deflector 173 are/is caused to move before the upper swing mechanism and/or the lower swing mechanism, so that interference between movement mechanisms may also be prevented, and decrease of an overall size of the air conditioner is facilitated.

Figure 28:
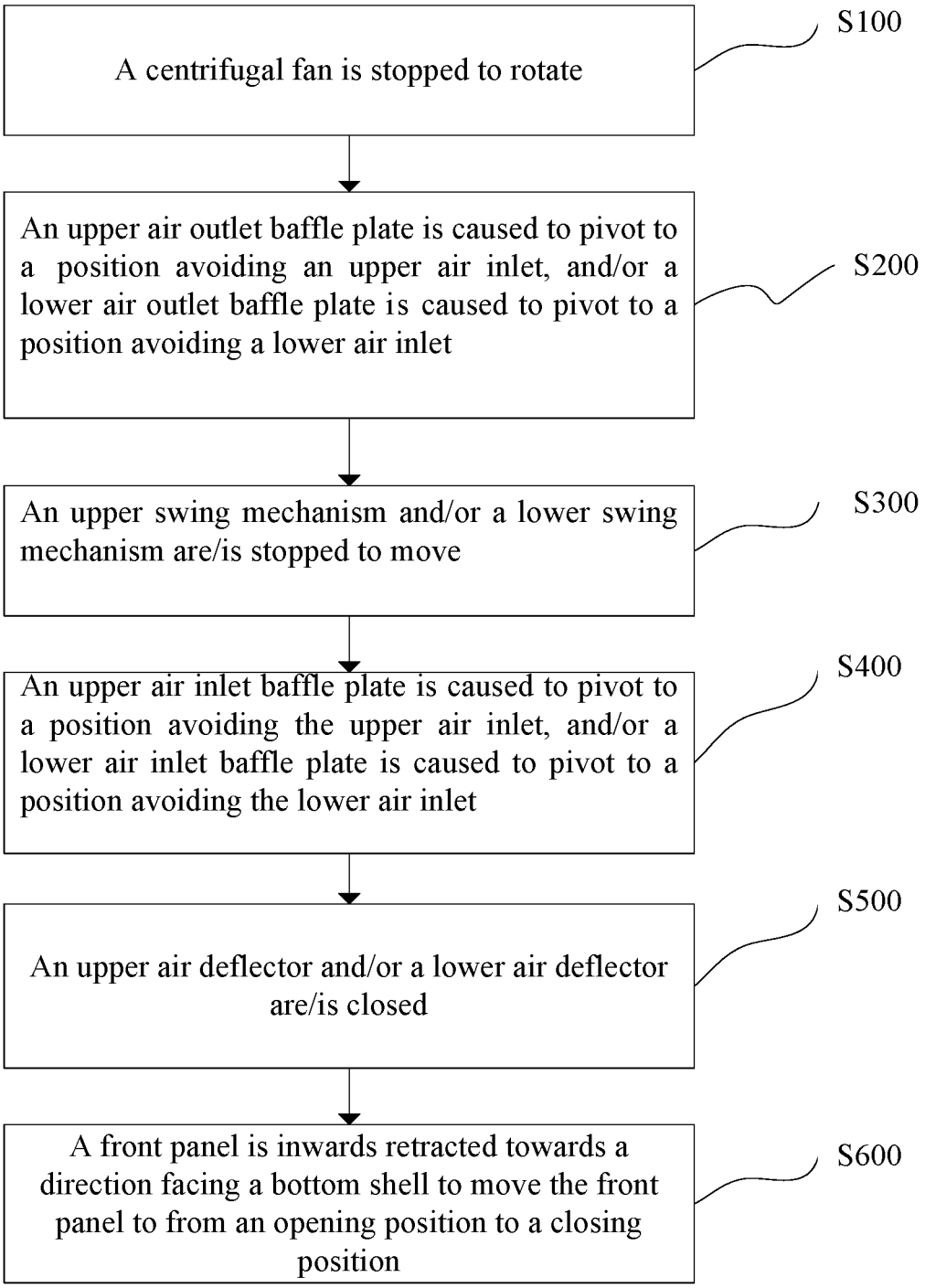
FIG. 28 is a flowchart of turning-off steps of an embodiment of a control method in FIG. 27.

As shown in FIG. 28, in the embodiment, the turning-off step comprises the following steps.

Step S100, the centrifugal fan 3 is stopped to rotate.

Step S300, the upper swing mechanism and/or the lower swing mechanism are/is stopped to move.

Step S500, the upper air deflector 171 and/or the lower air deflector 173 are/is closed.

Step S600, the front panel 6 is inwards retracted towards a direction facing the bottom shell 1 to move the front panel 6 to from the opening position to the closing position.

As shown in FIG. 28, in the embodiment, the following step is further comprised between Step S300 and Step S500.

Step S400, the upper air inlet baffle plate 81 is caused to pivot to a position avoiding the upper air inlet 61, and/or the lower air inlet baffle plate 82 is caused to pivot to a position avoiding the lower air inlet 62.

As shown in FIG. 28, in the embodiment, the following step is further comprised between Step S100 and Step S300.

Step S200, the upper air outlet baffle plate 91 is caused to pivot to a position avoiding the upper air inlet 61, and/or the lower air outlet baffle plate 92 is caused to pivot to a position avoiding the lower air inlet 62.

With application of the control method of the embodiment, the upper swing mechanism and/or the lower swing mechanism are stopped to move before the upper air deflectors 171 and/or the lower air deflectors 173 are stopped to move, and the front panel 6 is finally retracted. Therefore, interference between the movement mechanisms may be avoided.

Of course, those skilled in the art should know that, as an optional implementation mode, Step S200, Step S300, Step S400 and Step S500 may be executed synchronously. Or, only Step S200 and Step S300 are executed synchronously. Of course, for avoiding interference, the size of the air conditioner in the abovementioned two implementation modes may be slightly larger.

The above is only the preferred embodiment of the invention and not intended to limit the invention. For those skilled in the art, the invention may have various modifications and variations. Any modifications, equivalent replacements, improvements and the like made within the spirit and principle of the invention shall fall within the scope of protection of the invention.

What is claimed is:

1. An indoor unit of an air conditioner, comprising:

a bottom shell, at least two air passages are provided abreast in the bottom shell;

an air passage cover plate, provided on the at least two air passages in a covering manner, flow guide openings corresponding to the at least two air passages respectively are formed in the air passage cover plate;

at least two centrifugal fans, provided in the at least two air passages respectively and provided opposite to the corresponding flow guide openings; and an evaporator, provided on a side, far away from the bottom shell, of the air passage cover plate, each of the flow guide openings is provided opposite to the evaporator;

wherein each of the at least two centrifugal fans is provided with a flow guide ring, an air inlet opposite to a corresponding flow guide opening is provided in the flow guide ring, an annular air stopping protruding edge protruding towards the air passage cover plate is provided along a circumferential direction of the air inlet, and an air leakage preventing groove matched to the annular air stopping protruding edge is provided along a circumferential direction of the flow guide opening.

2. The indoor unit of the air conditioner as claimed in claim 1, wherein a vertical plate extending along side edges of the at least two air passages is provided on a side, facing the bottom shell, of the air passage cover plate, and the vertical plate is overlapped with sidewalls of the at least two air passages.

3. The indoor unit of the air conditioner as claimed in claim 1, wherein a support rib for supporting the evaporator is provided on a side, far away from the bottom shell, of the air passage cover plate.

4. The indoor unit of the air conditioner as claimed in claim 1, wherein each of the at least two air passages is provided with two air outlets, and air outlet directions of the two air outlets are different; one in the two air outlets of the each of the at least two air passages is provided in an upper part of the indoor unit of the air conditioner, and the other in the two air outlets is provided in a lower part of the indoor unit of the air conditioner.

5. The indoor unit of the air conditioner as claimed in claim 1, further comprising a front panel, wherein the front panel is provided on a side, back on to the bottom shell, of the evaporator, and the front panel (6) is forwards pushed out; the indoor unit of the air conditioner further comprising a panel body provided between the front panel and the evaporator, wherein the panel body comprises a frame and a filter net is provided on the frame in a covering manner; a grill is connected along an edge of the front panel, and the grill is provided in a manner of following the front panel.

6. The indoor unit of the air conditioner as claimed in claim 1, wherein the evaporator comprises a first heat exchanger, and the first heat exchanger is provided with the flow guide openings in a covering manner; or, the evaporator comprises second heat exchangers, and each of the second heat exchangers is provided at one of the corresponding flow guide openings respectively.

* * * * *